US010156073B2

(12) United States Patent
Harvey

(10) Patent No.: US 10,156,073 B2
(45) Date of Patent: Dec. 18, 2018

(54) MODULAR BUILDING SYSTEM

(71) Applicant: James F. Harvey, Magnolia, TX (US)

(72) Inventor: James F. Harvey, Magnolia, TX (US)

( * ) Notice: Subject to any disclaimer, the term of this patent is extended or adjusted under 35 U.S.C. 154(b) by 0 days.

(21) Appl. No.: 15/419,666

(22) Filed: Jan. 30, 2017

(65) Prior Publication Data

US 2017/0152659 A1 Jun. 1, 2017

Related U.S. Application Data

(63) Continuation of application No. 14/479,049, filed on Sep. 5, 2014, now Pat. No. 9,593,487.

(51) Int. Cl.
*E04C 2/34* (2006.01)
*E04B 2/10* (2006.01)
(Continued)

(52) U.S. Cl.
CPC ..... *E04C 2/34* (2013.01); *E04B 1/14* (2013.01); *E04B 1/161* (2013.01); *E04B 1/167* (2013.01); *E04B 1/18* (2013.01); *E04B 2/10* (2013.01); *E04B 7/20* (2013.01); *E04C 2/044* (2013.01); *E04C 2/06* (2013.01); *E04C 2/28* (2013.01); *E04C 5/06* (2013.01); *E04C 5/064* (2013.01); *E04C 5/168* (2013.01); *E04B 1/0007* (2013.01); *E04B 2/8647* (2013.01); *E04B 5/19* (2013.01); *E04B 5/21* (2013.01); *E04B 5/26* (2013.01); *E04B 5/28* (2013.01); *E04B 5/29* (2013.01); *E04B 2103/02* (2013.01); *E04C 5/167* (2013.01); *E04C 5/18* (2013.01); *E04C 5/20* (2013.01); *E04C 2002/045* (2013.01); *E04C 2002/3488* (2013.01); *E04G 21/1841* (2013.01)

(58) Field of Classification Search
CPC . E04C 5/064; E04C 5/168; E04C 2/06; E04C 2/044; E04C 2002/045; E04G 21/1841; E04B 2/10; E04B 2103/02; E04B 1/34321; E04B 1/167; E04B 1/161; E04B 2/8647
See application file for complete search history.

(56) References Cited

U.S. PATENT DOCUMENTS 2,653,469 A 9/1953 Callan
3,238,684 A * 3/1966 Wood ..... E04B 2/8635 52/379
(Continued)

FOREIGN PATENT DOCUMENTS

CA 2487000 A1 * 5/2005 ..... E04B 2/8647
DE 102009058691 A1 * 6/2011 ..... E04B 1/0007
(Continued)

*Primary Examiner* — Babajide A Demuren
(74) *Attorney, Agent, or Firm* — Norton Rose Fulbright US LLP

(57) ABSTRACT

A prefabricated modular reinforced concrete building system includes panel assemblies for foundations, walls, decks, and roofs designed to be built out in a manufacturing facility, shipped to a job site, and filled with concrete. Panel assemblies incorporate a space frame to ensure structural integrity during shipping and during concrete fill. Space frames can include structural columns, rebar mats, spacers, straps, and skin panels. Panel assemblies may be manufactured to contain architectural interior/external finishes, windows/doors, and pre-installed utility distribution systems.

20 Claims, 16 Drawing Sheets

(51) Int. Cl.

| | |
|---|---|
| ***E04C 2/04*** | (2006.01) |
| ***E04C 2/06*** | (2006.01) |
| ***E04C 5/06*** | (2006.01) |
| ***E04C 5/16*** | (2006.01) |
| ***E04B 1/16*** | (2006.01) |
| ***E04B 1/14*** | (2006.01) |
| ***E04B 1/18*** | (2006.01) |
| ***E04C 2/28*** | (2006.01) |
| ***E04B 7/20*** | (2006.01) |
| *E04B 2/86* | (2006.01) |
| *E04G 21/18* | (2006.01) |
| *E04B 1/00* | (2006.01) |
| *E04B 5/19* | (2006.01) |
| *E04B 5/21* | (2006.01) |
| *E04B 5/26* | (2006.01) |
| *E04B 5/28* | (2006.01) |
| *E04B 5/29* | (2006.01) |
| *E04C 5/18* | (2006.01) |
| *E04C 5/20* | (2006.01) |

(56) References Cited

U.S. PATENT DOCUMENTS

| | | | | |
|---|---|---|---|---|
| 3,383,817 | A * | 5/1968 | Gregorl | E04B 2/8635 52/309.11 |
| 3,555,751 | A * | 1/1971 | Thorgusen | E02D 19/04 249/40 |
| 4,125,981 | A * | 11/1978 | MacLeod | E04B 1/161 52/309.12 |
| 4,472,919 | A * | 9/1984 | Nourse | E04C 2/06 52/309.16 |
| 4,481,743 | A * | 11/1984 | Jellen | E02D 27/00 414/11 |
| 4,611,450 | A * | 9/1986 | Chen | E04C 2/22 428/222 |
| 4,864,792 | A * | 9/1989 | Andre | E04B 2/845 52/309.12 |
| 5,233,810 | A | 8/1993 | Jennings | |
| 5,528,876 | A * | 6/1996 | Lu | E04B 2/8658 52/425 |
| 5,608,999 | A | 3/1997 | McNamara et al. | |
| 5,611,183 | A * | 3/1997 | Kim | E04B 2/845 52/357 |
| 5,741,571 | A | 4/1998 | Bowerman et al. | |
| 5,758,463 | A | 6/1998 | Mancini, Jr. | |
| 5,809,725 | A | 9/1998 | Cretti | |
| 5,950,389 | A * | 9/1999 | Porter | E04B 1/6145 403/DIG. 15 |
| 6,098,359 | A | 8/2000 | Stodulka | |
| 6,151,857 | A | 11/2000 | Raschke | |
| 6,519,904 | B1 * | 2/2003 | Phillips | E04B 2/847 52/309.12 |
| 6,701,683 | B2 | 3/2004 | Messenger et al. | |
| 7,143,559 | B1 * | 12/2006 | Ritter | E04C 2/044 52/309.11 |
| 8,353,078 | B2 | 1/2013 | Bailey, Jr. | |
| 2003/0167716 | A1 * | 9/2003 | Messenger | E04C 2/044 52/309.12 |
| 2003/0177733 | A1 | 9/2003 | Izquierdo | |
| 2004/0035073 | A1 * | 2/2004 | Bravinski | E02D 27/02 52/426 |
| 2004/0065034 | A1 * | 4/2004 | Messenger | E04C 2/044 52/309.11 |
| 2004/0065043 | A1 * | 4/2004 | Foderberg | B28B 23/005 52/630 |
| 2005/0055926 | A1 | 3/2005 | Ben-Lulu | |
| 2005/0117977 | A1 | 6/2005 | Rasumussen | |
| 2006/0137289 | A1 | 6/2006 | Cotten | |
| 2006/0254068 | A1 | 11/2006 | Shotton et al. | |
| 2007/0107341 | A1 * | 5/2007 | Zhu | E04B 1/161 52/309.12 |
| 2008/0271401 | A1 * | 11/2008 | Grypeos | E04B 2/8652 52/426 |
| 2009/0007519 | A1 * | 1/2009 | Keshishian | E04C 2/044 52/794.1 |
| 2011/0131911 | A1 * | 6/2011 | McDonagh | E04G 11/062 52/426 |
| 2011/0168794 | A1 | 7/2011 | Lee et al. | |
| 2011/0272556 | A1 * | 11/2011 | Lin | E04G 17/0658 249/190 |
| 2012/0073227 | A1 * | 3/2012 | Urusoglu | E04B 1/161 52/309.4 |
| 2013/0014458 | A1 | 1/2013 | Boydstun, IV et al. | |
| 2013/0036688 | A1 * | 2/2013 | Gosain | E04B 2/8641 52/220.1 |
| 2013/0074432 | A1 * | 3/2013 | Ciuperca | E04B 1/21 52/309.4 |
| 2014/0013683 | A1 * | 1/2014 | Yin | E04B 5/16 52/223.6 |

FOREIGN PATENT DOCUMENTS

| | | | | |
|---|---|---|---|---|
| EP | 0381000 | A1 | 8/1990 | |
| EP | 1333129 | A1 | 8/2003 | |
| EP | 1347121 | A2 * | 9/2003 | E04B 5/32 |
| EP | 1361319 | A1 | 11/2003 | |
| EP | 1504160 | A2 | 2/2005 | |
| EP | 1655421 | A2 | 5/2006 | |
| EP | 2151330 | A1 | 2/2010 | |
| EP | 2369086 | A2 | 9/2011 | |
| EP | 2495374 | A1 | 9/2012 | |
| GB | 788762 | A | 1/1958 | |
| GB | 2291900 | A * | 2/1996 | E04B 2/845 |
| WO | 1988003204 | A1 | 5/1988 | |
| WO | 2003091506 | A2 | 11/2003 | |
| WO | 2004081310 | A2 | 9/2004 | |
| WO | 2007040412 | A2 | 4/2007 | |
| WO | WO 2009118480 | A2 * | 10/2009 | E04B 1/161 |
| WO | 2010033001 | A2 | 3/2010 | |
| WO | 2012024816 | A1 | 3/2012 | |
| WO | 2013061344 | A1 | 5/2013 | |

* cited by examiner

MODULAR BUILDING SYSTEM

CROSS-REFERENCES TO RELATED APPLICATIONS

The present application is a continuation of U.S. patent application Ser. No. 14/479,049, filed on Sep. 5, 2014, and entitled "Modular Building System."

TECHNICAL FIELD

This invention relates to the field of prefabricated concrete building construction.

BACKGROUND OF THE INVENTION

Current building methods are labor intensive, requiring on-site management of different kinds of contractors as well as facilitation of necessary building supplies. Project managers must coordinate with dozens of different skilled and unskilled tradesmen, while at the same time ensuring the proper building materials are available at any given jobsite at the correct time. Oftentimes certain contractors cannot meet the scheduled time slot and/or building supplies are either not delivered or are delivered in the incorrect form. As a result, on-site construction often suffers schedule delays plagued by cost overruns.

Even if everything goes according to plan, current on-site building methods are labor intensive. For example, in a typical residential build, first the foundation is laid by the foundation contractors. Then the framing and roofing contractors control the jobsite for several weeks. After that, different contractors build the exterior shell of the building. Then come the electricians, plumbers, and HVAC contractors. The insulator and sheet rock contractors follow. Then the electricians, plumbers, and HVAC contractors return to the job site to finish out their work. The work done by each trade must be inspected by inspectors on-site, leading to hold points and additional delays.

For at least these reasons, some on-site builders have turned to prefabricated construction techniques for portions of a building. For example, prefabricated deck trusses are often used in residential construction. Certain prefabricated building systems generally involve constructing portions of a building at a factory and shipping the fabricated piece to the jobsite.

A consistent problem with prefabricated building systems is weight. On the one hand, prefabricated pieces, in order to maintain structural integrity and load bearing capabilities, take on unnecessary shipping weight. On the other hand, to reduce weight for shipping, many prefabricated construction elements lack load bearing capabilities. Another problem with prefabricated building systems is shipping volume, where the maximum dimensions of a given room may be dictated by existing truck size. A need exists for a prefabricated system that incorporates both high structural integrity and lower shipping and assembly costs, as well as provides spacious room and building dimensions.

BRIEF SUMMARY OF THE INVENTION

There is provided a reinforced concrete building system that includes foundations, walls, decks, and roof assemblies designed to be built out in a manufacturing facility and shipped to a job site for final assembly. Panel assemblies are completed as fully as possible in the largest dimensions possible within the controlled environment of a manufacturing facility prior to transfer to a construction site. According to one aspect of the present design, wall assemblies are manufactured to contain architectural interior/external finishes, windows/doors, and pre-installed utility distribution systems. Panel assemblies are then assembled onsite into structures such as private residential homes, commercial spaces such as office buildings and strip malls, or even stand-alone walls for noise abatement or security. In addition, the system and methods described herein are suitable for secure military base structures. Panel assemblies can also be used as skirt walls for high-rise buildings.

According to one aspect of the present design, there is provided a building panel system of steel reinforced cement fiberboard panels configured to accept liquid concrete on a jobsite. Interior and/or exterior rebar mats join to a structural column system to provide reinforcement to the concrete. Spacers and straps connect to the rebar mats to create a structurally rigid space frame. Skin panels then connect to the space frame to create the panel assembly. The structural column system and space frame maintain integrity and alignment for transportation and assembly purposes. After being placed, the panel assemblies can be filled with concrete to provide structural integrity to the building.

In one embodiment, there is provided a modular panel assembly comprising a first and second rebar mat having a top edge, a bottom edge, and a pair of side edges, a first skin panel connected to the first rebar mat and a second skin panel connected to the second rebar mat, a plurality of structural columns, wherein the first and second rebar mats are connected to the structural columns, and the structural columns are disposed within the rebar mats at defined intervals, and wherein the rebar mats and skin panels are configured to define a center region for accepting concrete, and a plurality of spacers connected to the skin panels at defined intervals, wherein the spacers are configured to provide resistance against skin panel deformation. The panel assembly can also comprise straps disposed between the spacers and skin panels. The first and second skin panels can comprise cement fiber board. In one embodiment, the panel assembly further comprises a foldout rebar frame. In another embodiment, the panel assembly further comprises a hinge connected to at least one skin panel, wherein a portion of the at least one skin panel protracts to form the shell of a spread footer foundation.

In one embodiment, the panel assembly comprises a mount for moving the panel assembly by crane. This mount can take many forms and can be connected to the structural column or the space frame. For example, in one embodiment the mount slides into the structural column like a stabbing splice, where it is bolted in from the outside or from the inside near the top of the mount. In an alternate embodiment, the mount attaches to the space frame by, for example, looping hooks under the rebar strings. In another embodiment, the panel assembly comprises attachment points for the same purpose. The panel assembly can also comprise a plurality of spacer bolts attached to the spacers and configured to provide resistance against skin panel deformation. In another embodiment, the panel assembly further comprises conduit for utilities.

In yet another embodiment, a portable panel assembly comprises a plurality of structural columns spaced apart at intervals, a first space frame connected to the plurality of structural columns comprising, a first rebar mat connected to one side of the plurality of structural columns, a plurality of spacers connected to the first rebar mat, and straps connected to the spacers, the portable panel assembly also comprising a first skin panel connected to the external side of the first space frame. In still another embodiment, the portable panel assembly further comprises a second space frame connected to the plurality of structural columns comprising a second rebar mat connected to one side of the plurality of structural columns, a plurality of spacers connected to the second rebar mat, and straps connected to the spacers, and the assembly also comprises a second skin panel connected to the external side of the first space frame, and a center region disposed between the first and second skin panel for accepting concrete therein.

There is also disclosed a method of preparing a concrete wall for a building comprising connecting a first rebar mat to one side of a plurality of structural columns, connecting a second rebar mat to the opposite side of the plurality of structural columns, attaching spacers to the side of the first and second rebar mats distal to the plurality of structural columns, attaching straps to the side of the spacers distal to the plurality of the structural columns, attaching a skin panel to each side of the straps distal to the plurality of the structural columns so as to create a center region between the skin panels, and pouring concrete into the center region.

DETAILED DESCRIPTION OF THE INVENTION

The subsequent description and the figures illustrate specific embodiments to enable one skilled in the art to practice the system and method herein described. Other embodiments may incorporate additional elements, whether structural, logical, process or so forth. Examples are provided merely as possible variations. Individual components and functions are generally optional unless explicitly required, and the sequence of operations may vary. Portions and features of some embodiments may be included in or substituted for those of others.

In general, the design contained herein includes a system and method for prefabrication of quality modularized building components for economical transport and onsite construction. Panel assemblies capable of being filled with concrete are manufactured in an offsite facility and shipped to a jobsite where they are connected to each other and concrete is poured therein. Panel assemblies can take the form of multiple components of a given building under the present disclosure, including assemblies configured for walls, floors, decks, foundation, and roofs. As described herein, the term "panel assembly" refers generically to wall assemblies, foundation assemblies, floor form assemblies, deck assemblies, interior wall assemblies, and roof assemblies.

Panel assemblies are fashioned to be lightweight yet still strong enough to maintain rigidity during transportation, installation, and during pouring and setting of concrete within the center region. According to one embodiment, structural columns connect with space frames formed with rebar mats, spaces, and straps to form the structural skeleton of a panel assembly for transportation and installation. Panel skins are connected to the space frames, which are attached to the structural columns. This forms a central region capable of holding and forming concrete. Because concrete can be poured on-site, the transportation weight of building supplies is significantly reduced. In addition, the building process is dramatically simplified.

Figure 1:
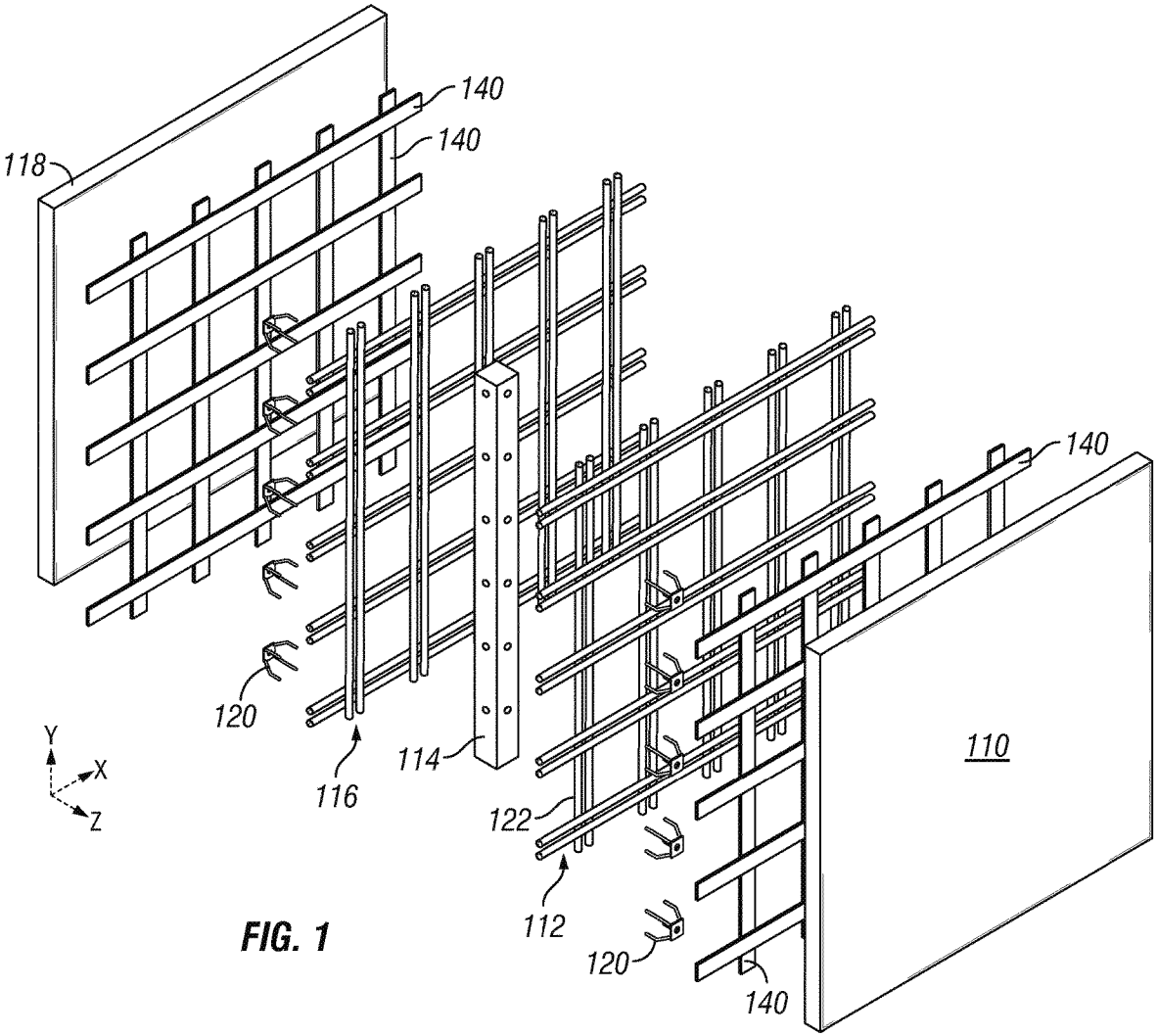
FIG. 1 shows an exploded view of a wall assembly, according to one aspect of the present disclosure.

FIG. 1 shows one embodiment according to the present disclosure of a wall assembly or panel assembly. Wall assembly 100, shown in exploded form in FIG. 1, comprises a plurality of structural columns 114, two rebar mats 112 and 116, a plurality of spacers 120, two mats of straps 140, and two parallel skin panels 110 and 118.

Structural columns 114 serve in a structural capacity during transportation and lifting of wall assembly 100, and provide dimensional control during assembly. They can also assist in combating hydrostatic loads of liquid concrete during pour and setting. According to the preferred embodiment, structural column 114 comprises a steel member of length matching the height of wall assembly 114, having the dimensions of 3"×3" at 1/16 gauge thickness. Bolt hole patterns are prefabricated at certain intervals, such as every four inches on each face of structural column 114. These dimensions and bolt hole pattern allow for structurally sound connections between structural columns 114 without adding too much weight, using stabbing splices to be described later in the present disclosure. Structural column 114 can, of course, have other dimensions and be formed from other types of metal, such as aluminum. In addition, structural column 114 can comprise plastics or composite material. It can also be fashioned out of formed rebar.

Figure 3:
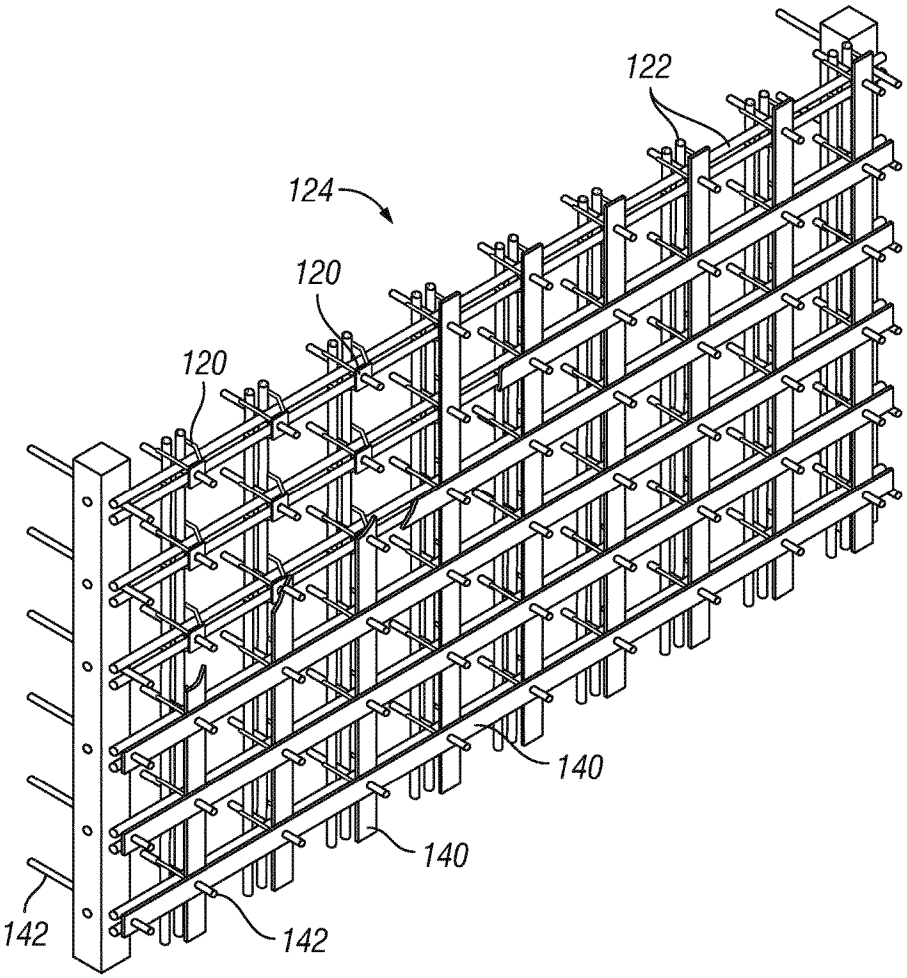
FIG. 3 shows a space frame of a wall assembly section, according to one aspect of the present disclosure.
Figure 2:
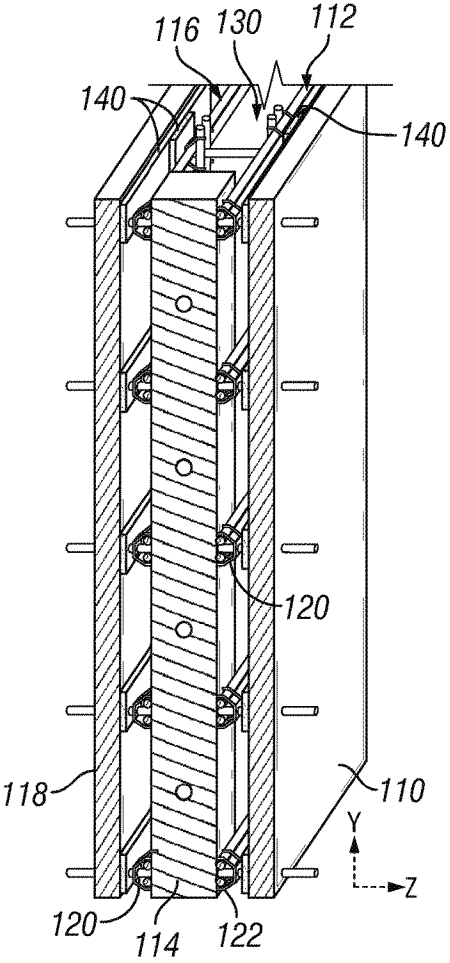
FIG. 2 is an edge-on view of a wall assembly, according to one embodiment of the present disclosure.

Rebar mats 112 and 116 and the attached straps 140 provide additional rigidity to wall assembly 100 during transportation, construction of building shell, and pouring of concrete. The rebar within the mats also serves as reinforcement of the concrete and to strengthen and hold the concrete in compression or tension. According to one embodiment, the rebar is ⅜ inch gauge. The rebar may be fashioned in other gauges, such as ¼ inch, ½ inch, ¾ inch, ⅝ inch, ⅔ inch, ⅞ inch or 1 inch. Other diameters can be employed. FIGS. 1-3 show rebar mats 112 and 116 as having the vertical rebar strings toward the center region 130. Other rebar mat configurations are contemplated, such as where the vertical rebar strings are located on the side away from center region 130. In FIG. 1, rebar mat 112 represents the inner wall assembly 100 mat, while rebar mat 116 corresponds to the mat closest to the exterior of the wall. In one embodiment, rebar mats 112 and 116 take the same dimension and can be used interchangeably. Consequently, for purposes of discussing the rebar mats themselves, element 112 can represent both. During discussion of construction of wall assembly, the inner and exterior differences will again be cited.

FIG. 2 shows an edge-on view of a portion of wall assembly 100 according to one embodiment. When assembled, there is presented a center region 130 where concrete can be poured and set to increase the structural rigidity of wall assembly 100 and thereby provide a safe, quiet, and comfortable environment. FIG. 3 depicts a portion of space frame 124 according to one embodiment of the present disclosure. For ease of display, only one space frame 124 is presented in FIG. 3, affixed to one side of structural columns 114. Straps 140 are partially cut out in FIG. 3 to better show rebar mat 112 and spacers 120. As seen in the embodiment in FIG. 3, a pair of strings 122 repeat at certain distances, such as every two feet, both in parallel and perpendicularly to produce rebar mat 112 (best shown in FIG. 1). Spacers 120 attach at the cross points of rebar strings 122. Straps 140 follow the pattern of rebar strings 122 and attach to spacers 120 to complete the space frame 124. Spacer bolts 142 are also shown in FIG. 3.

Figure 4A:
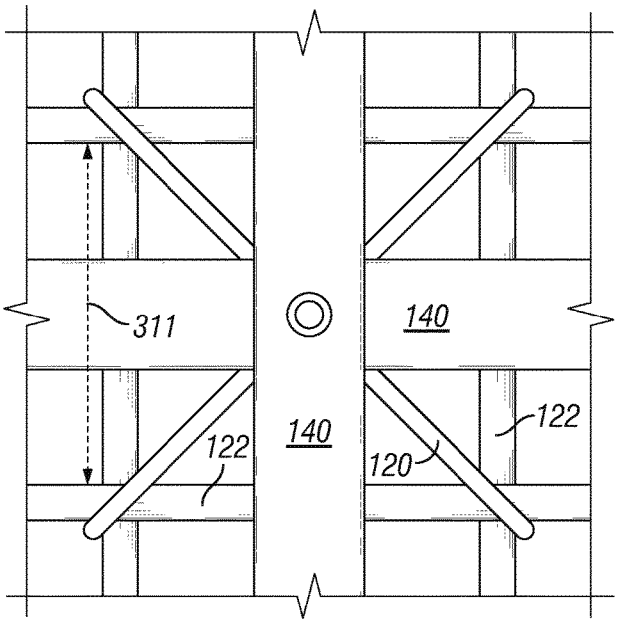
FIGS. 4A-C show a detailed plan view, side view, and end view of space frame connections as disclosed in one embodiment herein.
Figure 4B:
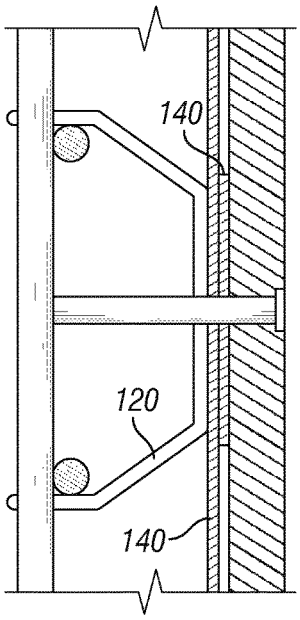
Figure 4C:
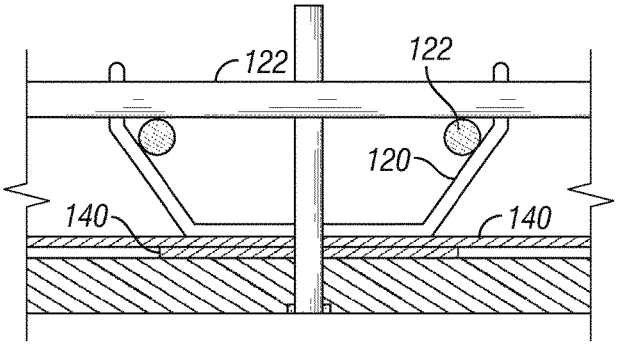

Rebar mat 112, in the preferred embodiment, comprises two strings 122 of rebar at 2 feet intervals repeating in the x and y plane of wall assembly 100. Where the two sets of strings 122 cross, spacers 120 can be welded or clipped. FIG. 4A shows two sets of rebar strings 122 crossing perpendicularly at a dimension 311. In certain embodiments, dimension 311 can be 1, 2, 3, 4, 5 or 6 inches. For larger panel assemblies, dimension 311 can be larger. This design is scalable. As shown in FIG. 4A, spacer 120 is attached to the two sets of strings. Spacers 120 provide attachment points for skin panels 110 and 118 but also add dimensional spacing between the skin panels and rebar mats for the concrete. FIGS. 4A-C provide additional views of spacers 120 according to one embodiment of the present disclosure. In this embodiment, spacers 120 are ⅛ inch steel and are attached at the intersection points of rebar strings 122. Spacers 120 can be welded to rebar mats 112, or clipped in. Spacers 120 not only add space between rebar mat 112 and skin panel 110, but they also improve the rigidity of the overall space frame 124 and they provide resistance against skin panel deformation. As seen in the embodiment in FIGS. 4B and 4C, each individual spacer 120 attachment area produces a rigid subframe, consisting of two sets of dual rebar strings as the base, followed by the four-pronged spacer 120 rising to the two cross straps 140. The end result is a subframe rigid in all three axes. The aggregation of these rigid subframes makes up space frame 124.

According to the embodiment in FIGS. 4A-C, spacers 120 are welded to rebar strings running in the x and y plane. At the other end, spacers 120 are welded to straps 140. Straps 140 run in the x and y directions as well as the rebar, but adjacent to skin panels 110 and 118. The connection of the rebar strings 122 together form the rebar mat 112 and the further connection of the rebar mat 112 to spacers 120 and straps 140 creates a truss structure, which improves the structural rigidity of the space frame 124. Spacers 120 can be fashioned from several materials such as steel, aluminum, and plastic. In addition, spacers 120 can be triangular in shape or take on other geometrical shapes, such as ellipses, rectangles, or squares. The spacers add distance between rebar mat 112 and the mat of straps 140. Spacers 120 may take a spider shape of four prongs (as seen in FIGS. 1 and 4), or they may contain two or three prongs.

Straps 140, according to one embodiment are ⅛ inch steel, having a width greater than the width of the top of spacer 120. It is understood that straps 140 can have various widths (for example, FIG. 4A shows a thin width, while FIGS. 4B-C show wider straps 140 and spacers 120), and can be wider than or less wide than spacers 120. Straps 140 can take other dimensions and gauges according to other embodiments depending on the expected stresses of transport and of concrete pouring/setting. In addition, straps 140 can be welded to spacers 120 or affixed with bolts or clips. Straps 140, in one embodiment are made from steel, but they can also be fashioned from aluminum or other metals. In addition, straps 140 can be fashioned from alternative materials such as composites or plastics. In yet another embodiment, the mat created by horizontal and vertical straps 140 can be substituted with an additional rebar mat so as to ensure the rigidity of space frame 124.

Figure 5:
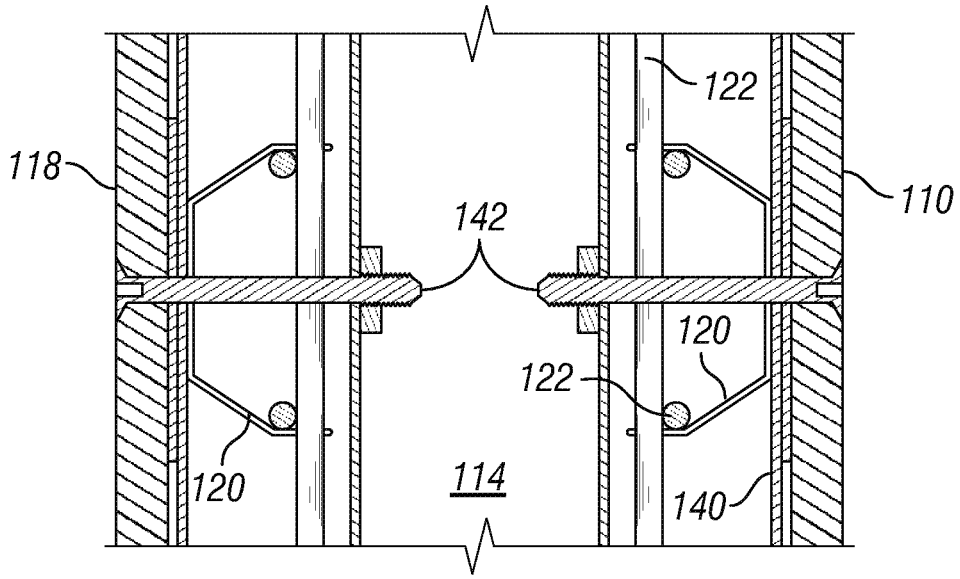
FIG. 5 details attachment of panel assembly components to a structural column, according to one aspect of the present disclosure.

Rebar mat 112 is attached to structural columns 114. In the preferred embodiment, this is accomplished with spacer bolts 142, as shown in FIG. 5. Threaded spacer bolts 142 attach to straps 140, spacers 120, and structural column 114. In one embodiment, spacer bolts 142 are long enough to attach to spacers 120 on both sides of the space frame 124, such that spacer bolt 142 is connected to straps 140, spacers 120, and structural column 114 on the exterior side of panel assembly 100 and on the interior side as well. In an alternative embodiment, spacer bolts 142 terminate at structural column 114 such that a separate spacer bolt 142 is used to affix each side of panel assembly 100 to structural column 114. Spacer bolts 142, according to one embodiment of the present disclosure, hold rebar mat 112 and 116 to structural column 114 through spacers 120 and straps 140 to create space frame 124. In addition, spacer bolts 142 add rigidity to space frame 124 in the z axis. Spacer bolts 142 can also be attached to skin panels 110 and 118 as described below. In one embodiment, such as where additional structural rigidity and dimensional control are desired, diagonal straps (not shown) can be installed. For example, diagonal straps may traverse rebar mat 112 from corner to corner.

Figure 6:
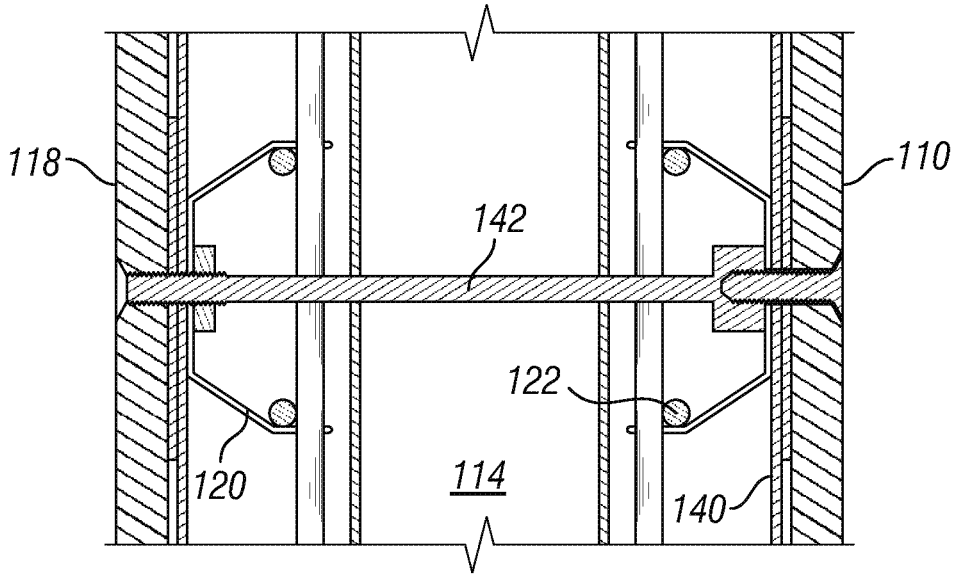
FIG. 6 is representative of one embodiment of wall spacers, according to the present disclosure.

Spacer bolts 142 can serve multiple purposes. For example, FIG. 6 shows the use of spacer bolt 142 in areas of panel assembly 100 that do not have structural columns 114. In this use, spacer bolts 142 are attached also to skin panels 110 and 118 to hold them against space frame 124. In one embodiment, spacer bolts 142 are placed at each location that has spacers 120. This provides additional rigidity of space frame 124 against deformation and alleviates stresses caused by the weight of liquid concrete while it is setting. According to one embodiment, any or all of spacer bolts 142, spacers 120, straps 140, and rebar 122 can be heavier gauge toward the bottom of wall assemblies 100 for this purpose, where the stresses are higher.

Skin panels can attach to spacer bolts in several ways. In one embodiment, spacer bolts 142 thread through a threaded fitting attached to, or embedded in, skin panels 110 and 118. See FIG. 6. In another embodiment, skin panels 110 and 118 contain holes with receptacles for threaded nuts embedded within the skin panel. In some embodiments, such as where exterior finishing is to be later applied, spacer bolts 142 run through exterior skin panels 118 and are affixed with a threaded nut. In other embodiments, a threaded fitting is embedded in exterior skin panel 118 so that spacer bolts 142 do not penetrate through the form. In this embodiment, spacer bolts 142 enter wall assembly 100 through interior skin panel 110. The interior head of spacer bolt 142 is countersunk so that skin panel 110 can be patched for interior finishing.

Wall assembly 100 is prefabricated in a manufacturing facility along with corresponding foundation assemblies, deck assemblies, and roof assemblies according to dimension specifications of the end building owner. Panel assemblies can be fashioned in multiple heights, lengths, and widths. For example, a prospective building owner may select wall assemblies 100 of 10' height and 48' length. Panel lengths (X axis) may be provided at 4', 8', 12', 16', 24', 32', 48' and up to a maximum shipping length. Panel heights (Y axis) are contemplated at 1', 2', 4', 8', 10', 12', and up to a maximum shipping height. Panel widths can also be adjusted by changing the width of structural column 114 and by adjusting the Z-direction length of spacers 120. This provides for thicker walls, decks, and foundations for concrete pours.

Wall assemblies 100 are assembled at the manufacturing facility. Rebar mats 112 and 116 are attached to structural columns 114. According to one embodiment, Spacers 120 are put in place along rebar mats 112 and 116. Straps 140 are put in place, and then skin panels 110 and 118 are attached to straps 140 and spacers 120. For exterior walls, it may be advantageous to avoid holes in skin panel 118 exposed to the outdoor elements. In that case, skin panel 118 is attached to rebar mat 116 using spacers 120 before being attached to structural columns 114. Then rebar mat 112 and skin panel 110 is put in place to complete the wall.

The end result is wall assembly 100 in a structural configuration for transport and lifting. Structural columns 114 provide structural support during transport and they provide attachment points for a mount to lift the assembly into place by a small crane. In addition, structural columns 114 provide temporary positioning and attachment points for securing wall assemblies 100 during transport and during on-site construction. Rebar mats 112 and 116 give additional support during transport and lifting. Wall assemblies 100 can be lifted from the transport truck and positioned into place on site via a small crane. After being attached to other panel assemblies in the building and leveled as needed, construction crews pour concrete into center region 130. Rebar mats 112 and 116 are encapsulated in concrete and provide reinforcement for the concrete wall.

Skin panels 110 and 118 are designed to remain in place after the concrete pour. In one embodiment, skin panels 110 and 118 are cement fiberboard. Cement fiberboard can be finished according to present day design such that no further work is required on the interior or exterior of a building. This includes a smooth finish, wood-simulated finish, masonry finish, and concrete block finish. In addition, skin panels can be fashioned from other components. For example, exterior skin panel 118 can be made from wood, plastic, fiberglass or metal. Interior skin panel 110 can also take these forms and be fashioned from wood, plastic, or metal. For exterior skin panels 118, the cement fiber board is operable to accept additional finishes such as brick, stucco, wood, siding, and other exterior finishes known in the art of building construction.

Figure 7B:
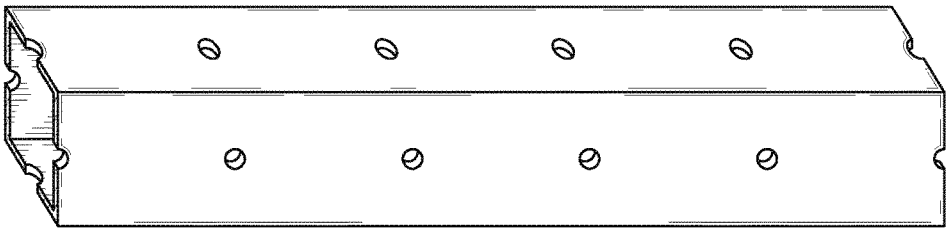
FIGS. 7A-B show one embodiment of the structural columns in the present disclosure.
Figure 7A:
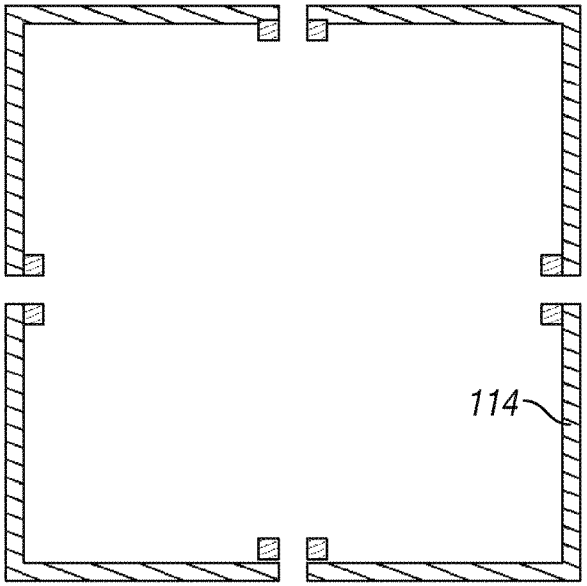

Structural columns 114, according to one embodiment, are located within space frame 124 every 8 feet but can be placed at alternate intervals depending on the anticipated transportation and concrete stresses. FIGS. 7A-B show one configuration of structural column 114 according to the present disclosure. In one embodiment, structural column 114 is a 3 inch square column of ⅛ inch steel. In other embodiments, structural column 114 can have other dimensions and gauges, and can take the form of a cylinder or tubular as well. In addition, structural column 114 can be fashioned of other materials such as plastic or composites. It can also be formed from rebar.

Figure 8A:
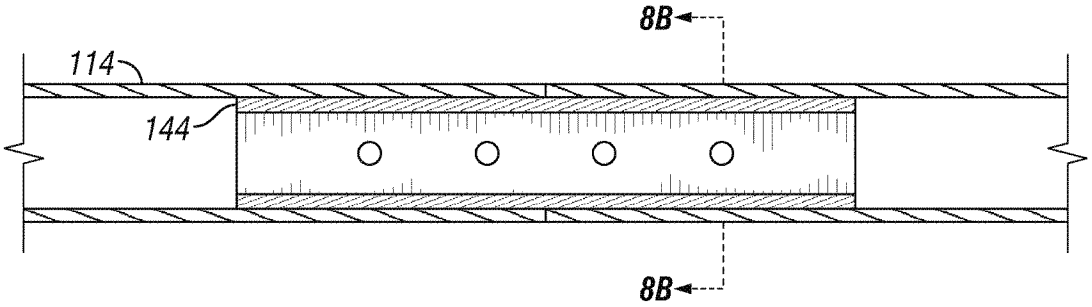
FIGS. 8A-C are representative of stabbing splices according to one embodiment of the present disclosure.
Figure 8C:
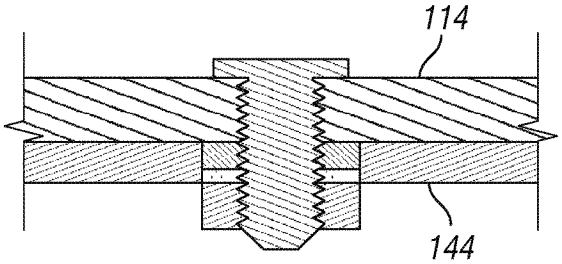
Figure 8B:
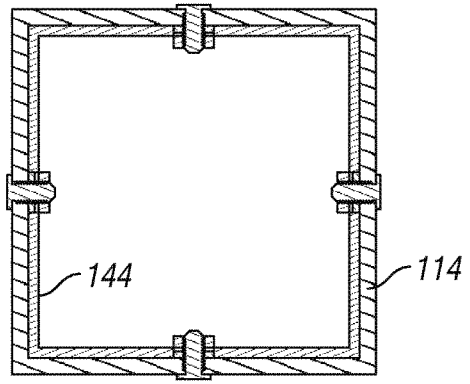

Structural columns 114 provide attachment points for wall assembly 100. For example, where panel assemblies attach to each other, brackets can bolt structural columns 114 together. In one embodiment shown in FIGS. 8A-C, stabbing splice 144 traverses the interior of structural columns 114 from two assemblies. Stabbing splice 144 is dimensioned to fit inside of structural columns 114 with bolt holes set to line up with the bolt holes in said structural columns. To make a 24' wall, therefore, two 12' wall assemblies 100 can be stacked on top of each other, with stabbing splices 144 used to connect the two wall assemblies 100 at the structural column 114 locations.

Figure 21:
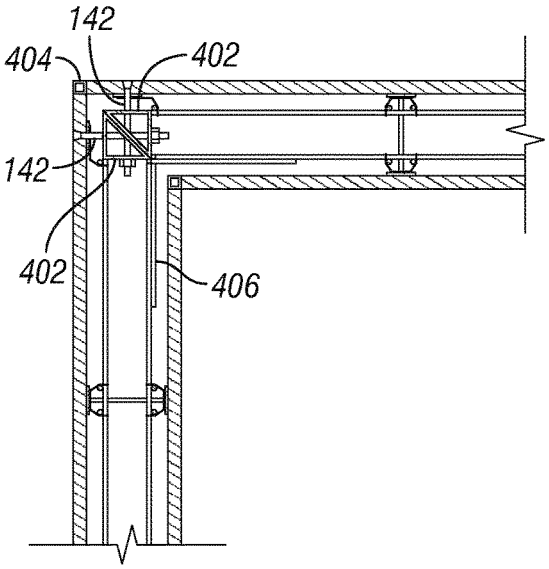
FIG. 21 is a plan view of a corner connection of panel assemblies.
Figure 22:
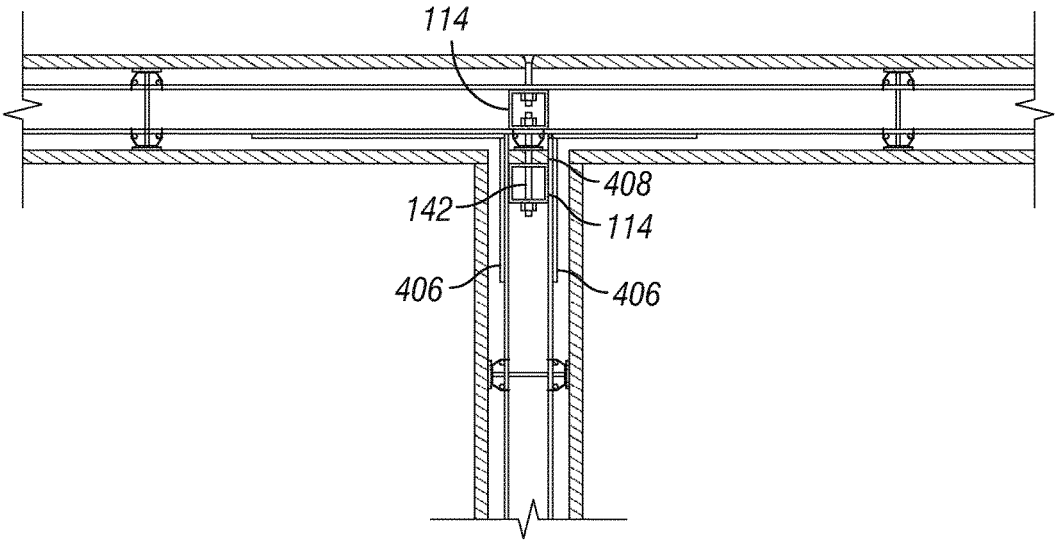
FIG. 22 is a plan view of a connection of a center wall assembly to an exterior wall assembly.

Wall assemblies 100 can attach to each other in several ways, such as the embodiments shown in FIGS. 21 and 22. FIG. 21 is a plan view representing one embodiment of two wall assemblies attached at a corner. In this embodiment, wall assemblies 100 contain diagonal end configurations, such that they mate to each other to form a corner. Diagonal split structural column 402 exists in the end section of wall assembly 100. Split structural column 402 can contain threaded bolt holes in both the diagonal portion as well as the portion closest to wall assembly's 100 exterior skin panel 118. When two wall assemblies 100 are mated to each other, the threaded bolt holes line up. Bolts are then inserted through both of the diagonal split structural columns 402. In one embodiment, diagonal structural columns 402 have alternating bolt hole patterns such that bolts inserted from one corner wall assembly 100 do not block bolts inserted from the other connecting wall assembly 100. The corner section of the mated wall assemblies 100 can either be formed by lining up the edges of the corresponding exterior skin panels 118, which are prefabricated to mate together, or exterior corner panel 404 can be used. Exterior corner panel 404 can fit flush to exterior skin panels 118, or it can be connected on the outside of the panels, such as in an end cap configuration. Corner panel 404 can be bolted and/or glued to wall assemblies 100 to provide a seal for concrete pouring. Corner panel 404 can be pre-installed during panel assembly fabrication and shipped with the panel assembly.

FIG. 22 shows an embodiment of a center wall assembly 100 connection. As shown, end structural column 114 in the center wall assembly lines up with the center structural column 114 of the exterior wall assembly structural column 114. The columns are simply bolted together. Spacer 408 can be placed between center wall assembly structural column 114 and the spacer 120 and strap 140 assembly to account for the thickness of interior skin panel 110.

Where wall assemblies 100 meet, there is provided corner rebar strings 406. Corner rebar string 406 is a string of rebar bent at 90 degrees. It is shipped within one of the wall assemblies and is rotated in plane with the assembly. Then, when the two wall assemblies are mated, corner rebar string 406 is rotated 90 degrees out of plane into the interior of the mating wall assembly, as seen in FIGS. 21 and 22. Wall assemblies can have clip receptacles to accept and clip in place corner rebar strings 406 when they are rotated into place.

Figure 9:
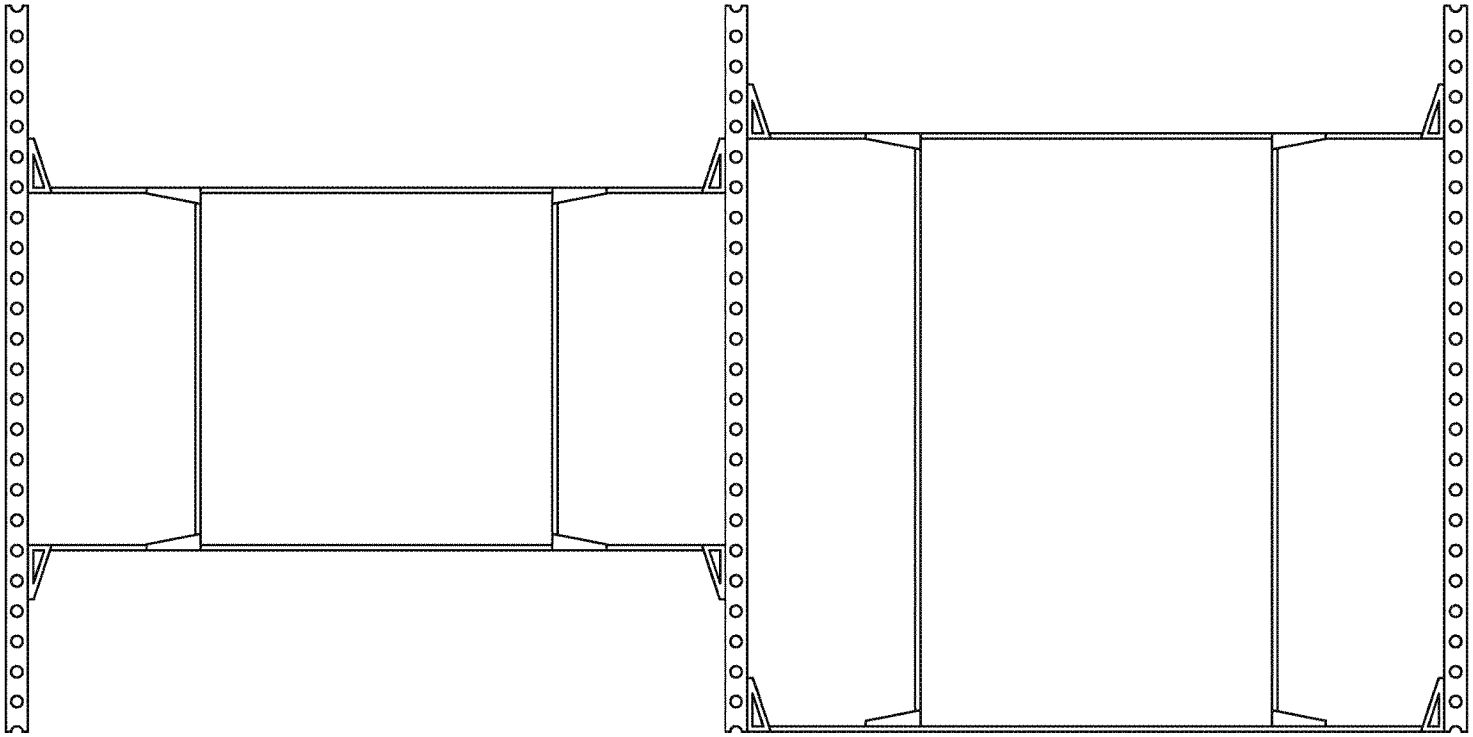
FIG. 9 illustrates one embodiment of inserting door and window frames, according to the present disclosure.

Wall assemblies 100 can include doors and windows. Window forms are installed at the factory according to the specifications of the building owner. In one embodiment, shown in FIG. 9, window and door frames operate to match the rebar string configuration. In another embodiment, standard commercial windows and doors are used. Where windows and doors are positioned, portions of space frame 124 are removed in wall assemblies 100. Frames are installed and clipped, bolted, or welded to space frame 124 or to structural columns 114 to prevent poured concrete from impinging on the windows or doors. Wall assemblies 100 are shipped with doors and frames already installed.

As summarized, wall assembly 100 as disclosed herein is fabricated in a manufacturing facility according to the specifications requested by a building owner and shipped to an on-site location where it is attached to other panel assemblies. Concrete is then added to the center region 130 and allowed to set. Wall assemblies can be set in place quickly with a light-duty crane. Concrete is poured directly into the center region 130 through the top of the wall from a concrete truck. Thus, on-site labor costs are drastically reduced. Moreover, the reinforced concrete construction is much stronger than conventional wooden construction.

Additional panel assemblies are disclosed herein. According to one embodiment, there is disclosed a foundation assembly. Conventional foundation forming is a labor intensive and time consuming process. For example, in standard residential construction, contractors must build a wooden frame onsite that is both level and can withstand the hydraulic load of wet concrete. Then the contractors must lay out reinforcing bars and individually strap them together, raising additional potential for human error. After the concrete is poured and set, the wooden forms are removed and the remaining ground space is backfilled with soil. Apart from the number of workers on the jobsite, this process can take 6-8 days to complete. Using the system and method disclosed herein, the process is cut to less than 1-2 days, and the number of workers required is dramatically reduced.

Figure 10C:
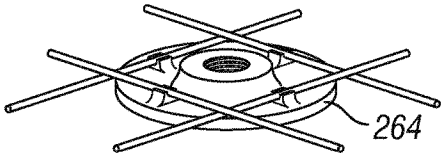
FIGS. 10A-D show one embodiment of a wall foundation assembly.
Figure 10D:
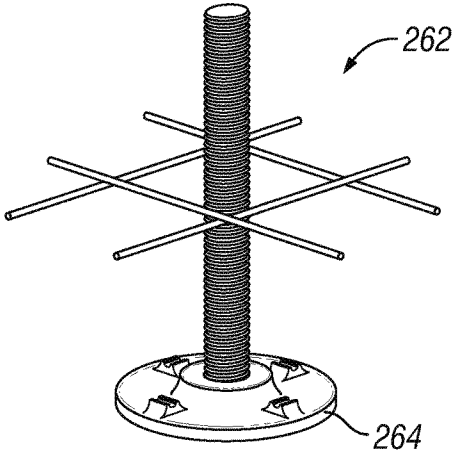
Figure 10B:
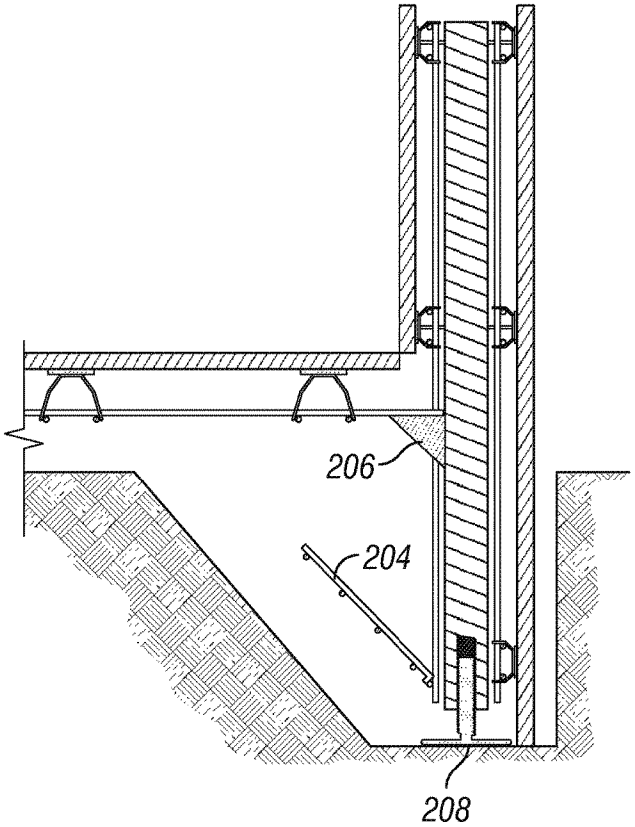
Figure 10A:
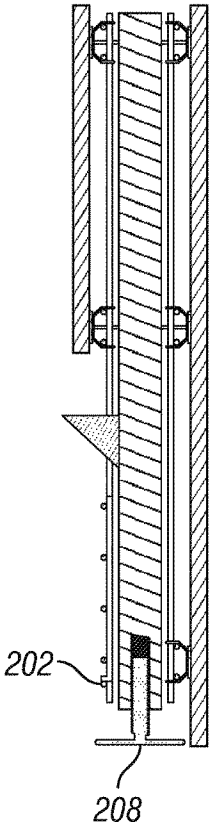
Figure 11A:
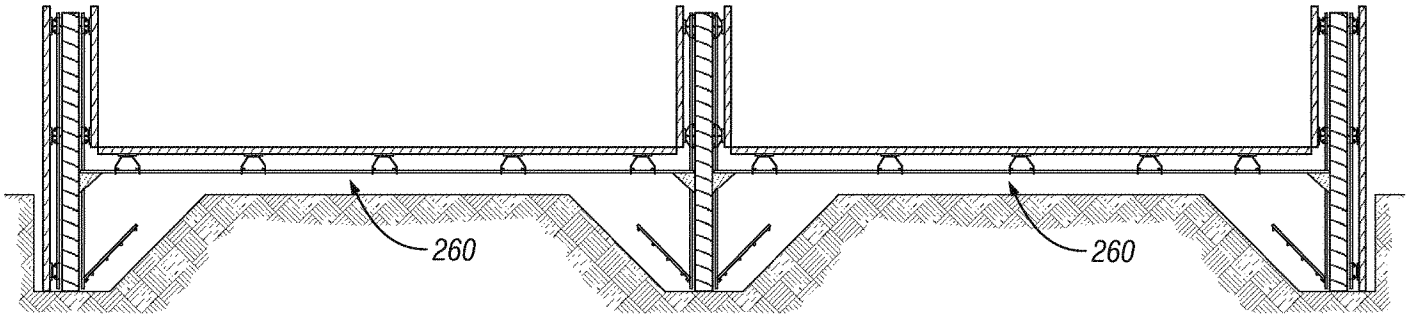
FIGS. 11A-C are representative of floor form assemblies, according to one aspect of the present disclosure.
Figure 11B:
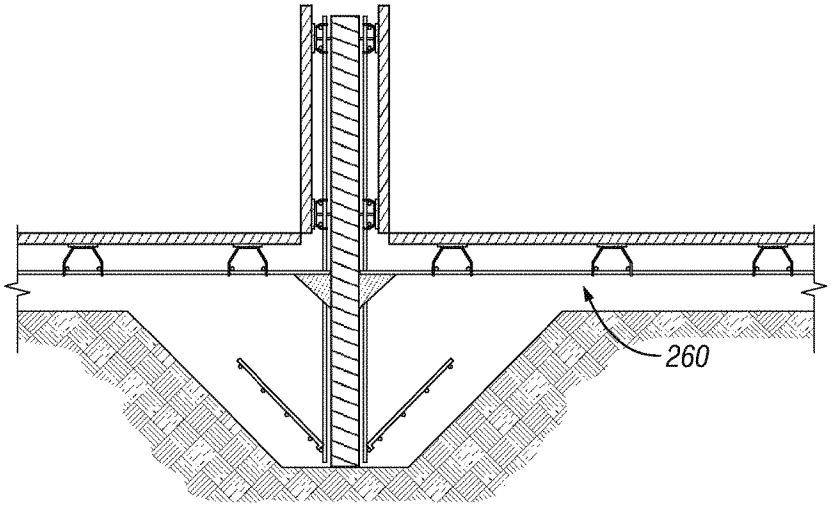
Figure 11C:
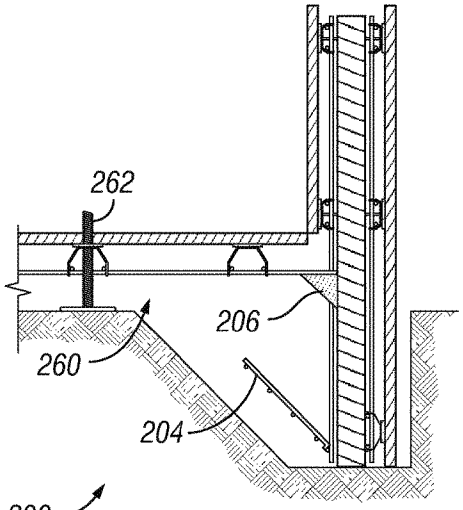

FIGS. 10 and 11 show wall foundation assembly 200 according to one embodiment of the present disclosure. Wall foundation assembly 200 can be fabricated as the lower portion of wall assembly 100 (as shown in FIG. 10), or wall foundation assembly 200 can be its own standalone piece (not shown), configured to be attached to any given wall assembly 100. According to the design shown in FIGS. 10A-B and 11C, wall foundation assembly 200 contains, on the interior side of the assembly, hinge 202, and foldout rebar frame 204.

The wall foundation assembly 200 portion has a cutout of space frame 124 of a certain dimension, such as 16 inches as shown in the figures. In one embodiment, the interior rebar mat 112, interior spacers 120, interior straps 140, and interior skin panel 110 are not present, so that foldout rebar frame 204 can be swiveled into place after positioning of wall foundation assembly 200. In an alternate embodiment, the interior portion of space frame 124 remains in place in the lower portion of wall foundation assembly 200, and foldout rebar frame is attached on the interior side of space frame 124, where interior skin panel 110 would normally exist.

Wall foundation assembly 200 includes a leveling apparatus 208. In one embodiment, the leveling apparatus is placed within the interior of structural column 114. Reach rods from the top of the column engage the leveling devise for raising/lowering the wall/foundation. In another embodiment, standard manual torque gears are accessed through one of the bolt holes of structural column 114. In the alternative, leveling apparatus 208 can take the form of traditional jack systems known in the art.

For load bearing walls in the center portion of a building, wall foundation assembly 200 can be outfitted with dual foldout rebar frames 204 as shown in FIG. 11B.

Figure 12B:
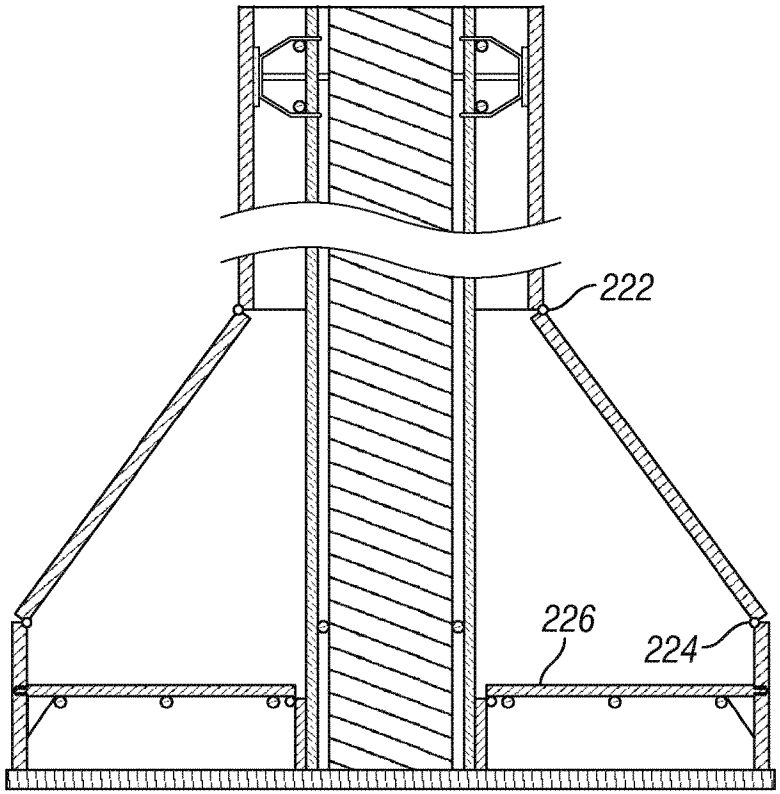
FIGS. 12A-B show one embodiment of a spread footer wall foundation assembly.
Figure 12A:
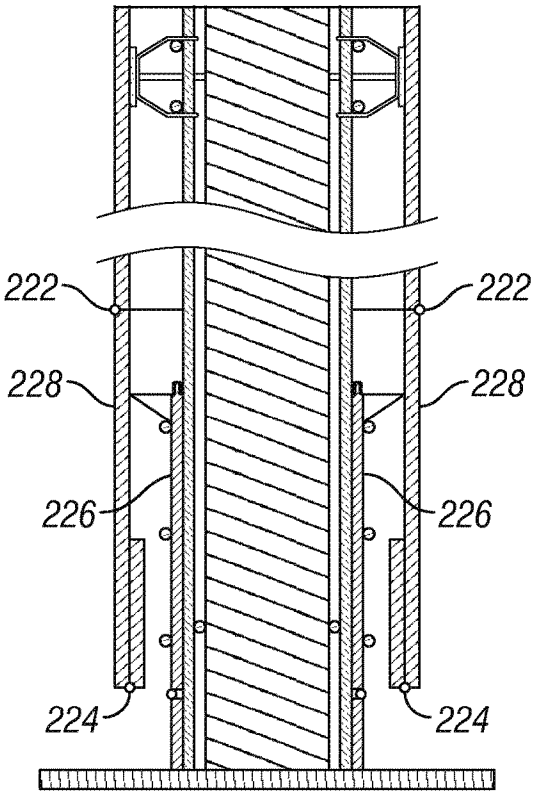

In colder climates, the bottom of the foundation must be placed below the frost line to prevent frost heave, where the pressure created by water freezing forces the foundation upwards. In one embodiment, spread footer wall foundation assembly 220 has a spread footer design shown in FIGS. 12A-B. Spread footer wall foundation assembly 220 is shipped with lower skirt skin panels 228 in retracted configuration to fit within the shipping width of the walls as shown in FIG. 12A. When set in place, lower skirt skin panels 228 expand or protract through upper spread footer hinge 222 and lower spread footer hinge 224. Fold out rebar frame 226 rotates down to lock lower skirt skin panels 228 in place and provide rigidity against hydraulic stresses of liquid concrete. When lower skirt skin panels 228 are protracted, they can form a bell-shaped shell for containing concrete. Fold out rebar frame 226 also contains rebar to reinforce the concrete. Fold out rebar frame 226 can bolt onsite to lower skirt skin panels 228 or they can clip in, using the weight of the rebar to maintain attachment to panels 228.

Spread footer wall foundation assembly 220 can occupy the lower portion of wall assembly 100 or can be a separate attachment that is attached to the bottom of wall assembly 100 onsite via a stabbing splice 144 described earlier. The bell shape of the spread footer design allows more rigid control of foundation concrete and is optimal for below frost environments. More importantly, it enables dirt to be backfilled prior to concrete pouring/curing. FIG. 12B shows one embodiment of the spread footer design, representing the lower portion just after lower skirt panels 228 are flared out. Once spread footer wall foundation assembly 220 is leveled, soil can then be backfilled to close the gaps prior to concrete pouring. In another embodiment, lower skin panels 228 are flush with the ground soil so that concrete pouring can occur prior to backfilling. Spread footer wall foundation assembly 220 can also be used in non-frost environments.

In one embodiment, multiple fold out rebar frames 226 (not shown) can be located on each side of spread footer wall foundation assembly 220 so that additional rebar is distributed through the bell shape lower foundation housing form demonstrated in FIG. 12B. Canvas cloth is included with the fold-out foundation to both provide moisture proofing of the foundation from the soil, but additionally to capture cement where the bottom of the foundation does not rest on the soil.

FIGS. 11A-C show a floor form assembly 260 supported on ground according to one embodiment of the present disclosure. Floor form assembly 260 takes the form of wall assembly 100 with only one space frame and one skin panel.

Interior skin panel 110 becomes the floor board of the foundation. Rebar mat 112 serves the purpose of reinforcing the foundation slab. According to this embodiment, once wall foundation assemblies 200 are positioned around the exterior of the building, floor form assemblies 260 are laid in between. Depending on the dimensions of the foundation, floor form assembly 260 can contain independent leveling apparatuses 262. These leveling apparatuses 262 are accessed through the interior skin panel 110. Level apparatus 262, according to the embodiment shown in FIG. 11C, is located where spacers 120 meet interior panel 110. Onsite workers can manually level central portions of the floor prior to pouring the concrete. In one embodiment, leveling discs 264 are pre-attached to rebar mat 118 where X and Y rebar strings 122 meet (see FIG. 10C). These discs 264 are clipped on to the rebar mat. If a worker decides that a certain portion of floor form assembly 260 needs to be raised for leveling, the worker can simply insert a bolt into floor form assembly 260. The bolt will have a smaller diameter thread adapted to meet and connect to leveling disc 264. When it meets and connects, leveling disc 264 is forcibly unclipped from rebar mat 116 and driven to the foundation soil where it engages and lifts floor form assembly 260, as seen in FIG. 10D. In embodiments of thicker foundations, floor form assembly 260 includes both interior and exterior space frames (not shown) thereby doubly reinforcing the foundation with two rebar mats.

Floor form assemblies 260 are attached to wall foundation assemblies 200 by use of deck mount 206. Deck mount 206, according to one embodiment, is a triangular truss piece that clips or bolts on to structural column 114 or interior rebar mat 112 of wall foundation assembly 200. Floor form assembly 260 then rests on or clips to deck mount 206. The center portions of floor form assemblies 260 rest on the sub-foundation soil and therefore do not need to be suspended. Floor form assemblies 260 can be leveled as discussed above. In an alternate embodiment, floor form assemblies 260 can contain exterior skin panels 118 and/or exterior spacers 120 and straps 140.

Floor form assemblies 260 can be attached together with quick connectors that provide accurate dimensional control. Connectors are contained within one of the floor panels and can be extended to the next panel, for quick assembly. In the alternative, connectors can be contained in all floor panels and extended to mate with each other. Systems include tongue and groove clips, bolt systems, and other mating systems known in the art. In addition, floor form assemblies 260 can include prefabricated receptacles for accepting external coupling members. These can be specially formed brackets that bolt or clip into the receptacles and may contain floor finishes to match the external skin panel floor.

Figure 13:
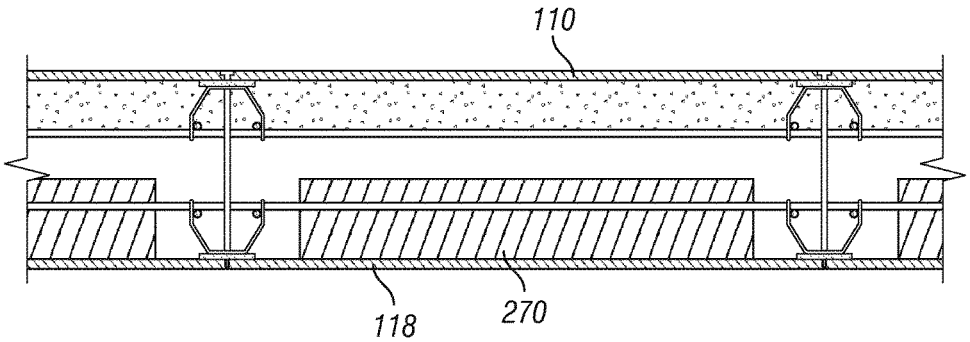
FIG. 13 shows a side view of thermal insulation installation according to one embodiment of the present disclosure.
Figure 14:
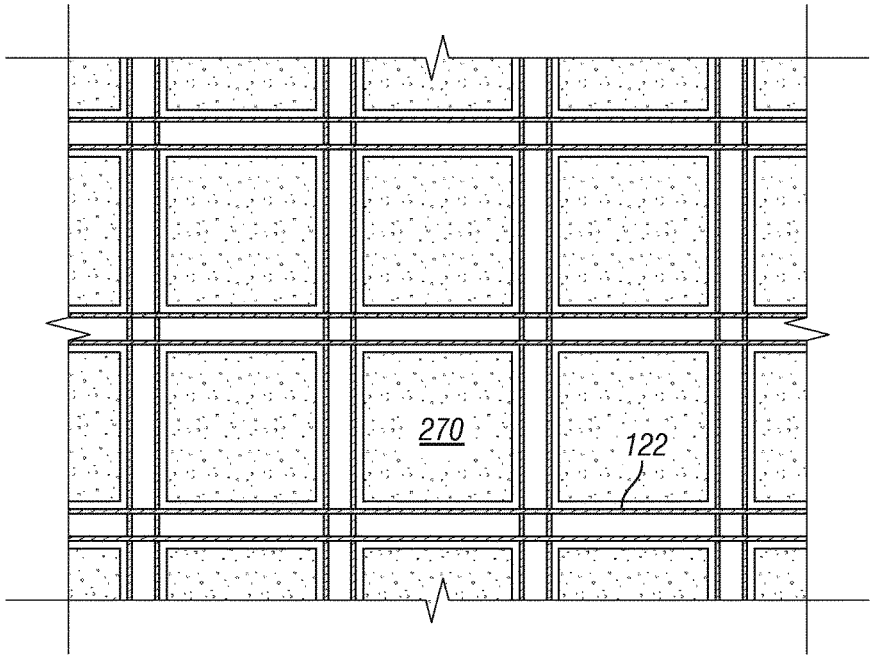
FIG. 14 shows a plan view of thermal insulation installation according to one embodiment of the present disclosure.

In some cases, a building owner may wish to improve the thermal insulation properties of the building. One embodiment, shown in FIG. 14, discloses thermal panels 270. According to this embodiment, thermal panels 270 are 18"×18" foam panels configured to fit in between rebar mats 112 and 116. Thermal panels 270 can be of various thicknesses, such as 1, 1.25, 1.5, 1.75, 2, 3, 4 inches, and thicknesses therebetween. FIG. 13 shows a side view of a panel assembly having a high thickness thermal panel 270. The thickness depends both on the preferred thermal resistivity and the overall thickness of space frame 124. During fabrication of wall assembly 100, thermal panels 270 are affixed to exterior skin panel 118. Thermal panels 270 may also be affixed to interior skin panel 110. In one embodiment, skin panels 110 and 118 are preformed to include thermal panels 270. Thermal panels 270 can be formed in alternate dimensions, according to the dimensions of the rebar mats 112 and 116, and can also help to shape concrete walls floors and decks. For example, in FIG. 13, thermal panels 270 are fashioned to create a T-shape of concrete within panel assembly 100, thereby maintaining strength while reducing weight.

Figure 15:
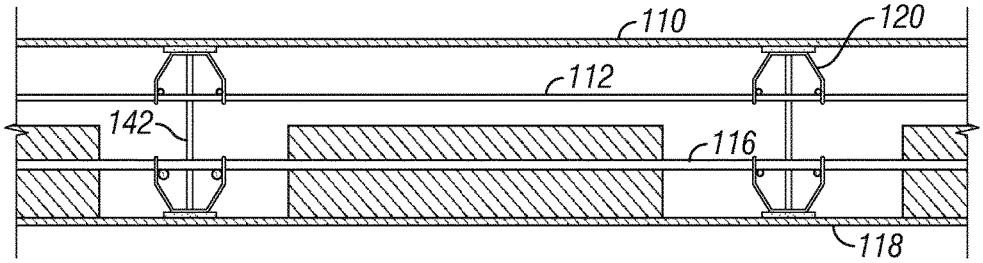
FIG. 15 shows details of a deck assembly, according to one embodiment of the present disclosure.
Figure 16:
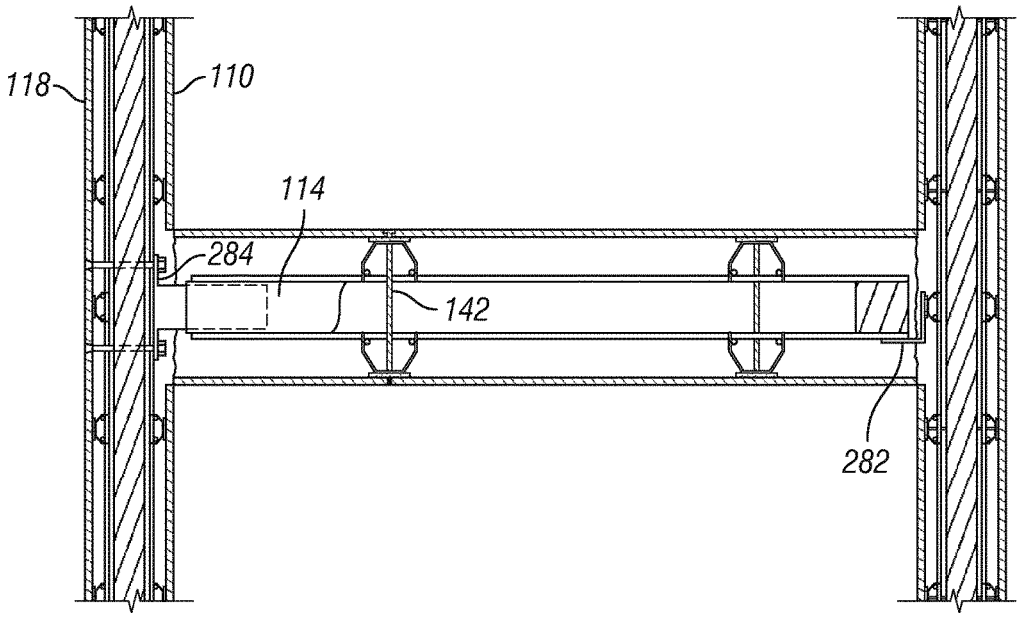
FIG. 16 shows connection of deck assemblies to wall assemblies, according to one embodiment of the present disclosure.

For multiple story structures, decks may be used with the present design. Unlike the floor forms, decks are suspended and become both floors and ceilings. Deck assemblies 280, shown in FIGS. 15 and 16, are conceptually the same panels as those used for the wall systems, except that deck assemblies 280, unlike wall assemblies 100, are installed horizontally. As such, the steel reinforcing in the deck lower panel is increased in gauge to carry the deck loads, according to one embodiment. In the example disclosed herein, exterior rebar mat 116 and exterior skin panel 118 of deck assembly 280 will represent the lower portion of the installed assembly 280, with the interior portion representing the upper portion. As seen in FIG. 15, thermal panels 270 may occupy only one side of deck assembly 280. In one embodiment, thermal panels 270 can also have a depth that takes the upper edge of thermal panel 270 above exterior rebar mat 116.

According to one embodiment, lower rebar mat 116 is formed of heavier gauge rebar, which provides additional reinforcement for the lower portion of deck assembly 280 Likewise, lower skin panel 118 is thicker and stronger than upper skin panel 110, according to this embodiment. This provides additional strength during pouring and setting of the concrete. For large spans, it is contemplated that temporary supports are provided during pouring and until the concrete sets. The supports rest under the lower skin panel 118.

In one embodiment, lower skin panel 118 is geometrically formed to handle additional loads, such as through corrugation Like in wall assemblies 100, lower skin panels 118 are attached to space frame 124 by spacer bolts 142. Lower skin panel 118 forms the ceiling of a given room. In one embodiment, spacer bolts are threaded into lower skin panel without punching through the skin panel, so that the ceiling portion of the structure does not need to be patched. Upper skin panel 110 forms the floor of a given room. Bolt holes are patched and the finished floor is installed over upper skin panel. In one embodiment, bolts are installed from the lower skin panel 118 side, so that upper skin panel 110 can be a finished floor with no patches.

Depending on the structural requirements, deck assemblies can be filled in part with foam. FIG. 13 shows one such embodiment. Foam panels 270 are installed at 4 inch thickness to create a T-shaped deck. This reduces weight while maintaining structural capability. It also reduces noise and improves thermal insulation. Other thicknesses of thermal panel may be used.

Deck assemblies are attached to wall assemblies 100 in several ways. In one embodiment, deck assembly support mount 282 is bolted into selected structural columns 114 of wall assemblies 100, as seen in FIG. 16. Cutouts on interior skin panel 110 of wall assembly 100 are drawn at the manufacturing facility. Onsite contractors cut out a portion of interior skin panel 110 and insert deck assembly support mount 282 and bolt into structural column 114. Because this is done before pouring the concrete of wall assembly 100, deck assembly support mount 282 can come with a preformed interior skin panel 110 patch. The lower skin panel 118 of deck assembly 280 can rest on top of deck assembly support mount 282. In an alternative embodiment, deck assembly support mount 282 is inserted into the space frame 124 portion of deck assembly so that the rebar mats 112 or 116 of deck assembly 280 rest on mount 282.

In one embodiment, deck assembly support mount 282 is attached to space frame 124 of wall assembly 100. As shown in FIG. 16, mount 282 is bolted into strap 140 and spacer 120. If mount 282 is mounted to wall assembly 100 on the outside of interior skin panel 110 (not shown) then it can be mounted after concrete is poured into wall assembly 100. If interior skin panel 110 is cut out of wall assembly 100 prior to mounting, then mount 282 is mounted prior to the pouring of concrete in both wall assembly 100 and deck assembly 280. In the alternative, deck assembly support mount 282 can be clipped into interior rebar mat 112 prior to pouring concrete. In another embodiment, deck assembly stabbing mount 284 is inserted into the structural columns 114 of deck assembly 280. The bolt holes in the top of this mount align with bolt holes in structural columns 114 of wall assembly 100 and are bolted from the outside of the structure. This design removes the need for deck assembly 280 to rest on deck assembly support mount 282. It also reduces the patchwork required after concrete pouring. The entire deck assembly 280 can be lowered in place with deck assembly stabbing mount 284 fully retracted. When suspended in place, external bolts mate with deck assembly stabbing mount 284 and extract the mount to lock in place with structural column 114.

Figure 23:
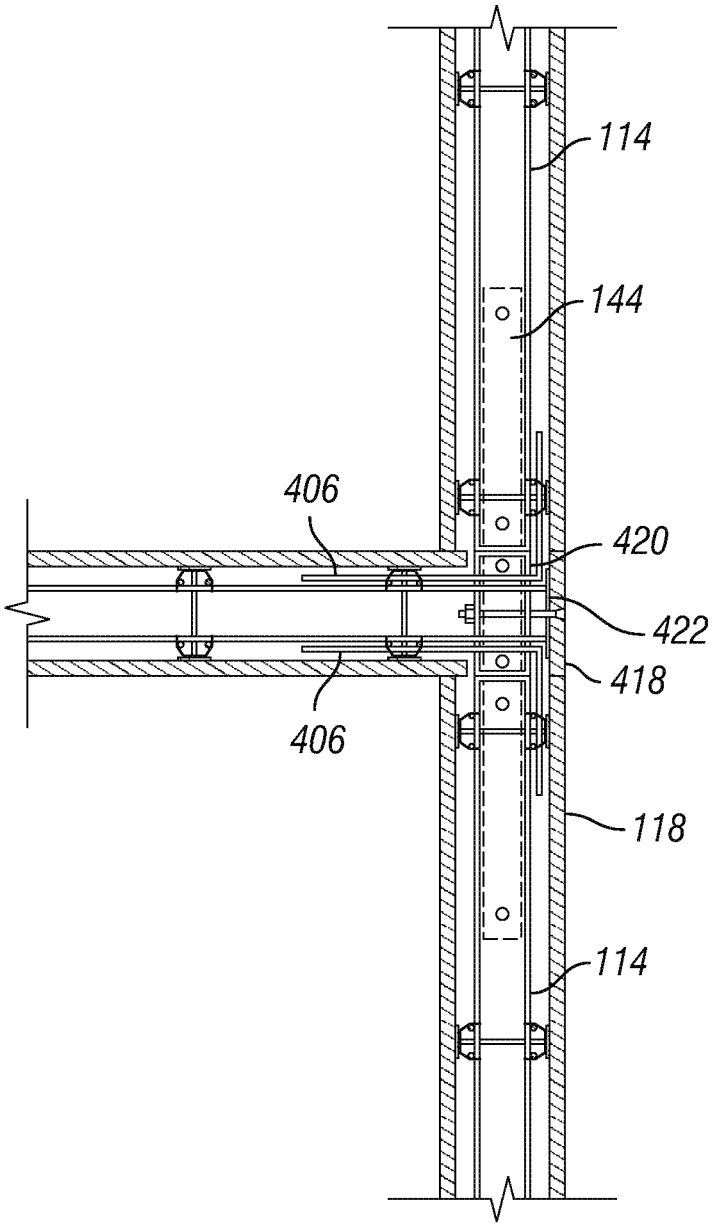
FIG. 23 shows one embodiment of a connection of a deck assembly to a wall assembly.

Deck assemblies 280 can be placed on the outside of interior skin panel 110. In the alternative, interior skin panel 110 of wall assembly 100 can be removed prior to placement of deck assembly, as shown in FIG. 16. FIG. 23 shows an alternative embodiment of the deck mounting system. Here, deck assembly 280 is designed to be placed at the top section of wall assembly 100, or in between two wall assemblies 100. Deck assembly 280 contains, on its horizontal end, a vertical deck end structural column 420. Stabbing splice 144 is first inserted into and bolted to structural column 114 of lower wall assembly 100. Vertical deck end structural column 420 is lined up with stabbing splice 144 and then deck assembly 280 is lowered into place. If an additional wall assembly 100 is to be added in place above deck assembly 280, then it is lowered onto stabbing splice 144 and bolted into place, as shown in FIG. 23. In the alternative, deck end structural column 420 can be rested on top of the upper end of the lower wall assembly's 100 structural column 114. Stabbing splice 144 is then inserted through both structural column 100 of lower wall assembly 100 and deck end structural column 420. Stabbing splice 144 is then bolted in place. Deck assembly 280 can also contain its own exterior skin panel section 418 in the vertical, configured to rest above and below exterior skin panels 118 of lower and upper wall assemblies 100 respectively. In the embodiment shown in FIG. 23, exterior skin panel section 418 is attached to rebar end plate 422, which is welded to the end of rebar strings 122 of deck assembly 280.

Like floor form assemblies 260, multiple deck assemblies 280 can be put into place within a structure. Deck assemblies 280 can be attached together in the same fashion as floor form assemblies 280 (see above). In addition, receptacles can be placed on the underside of deck assemblies 280.

Figure 17:
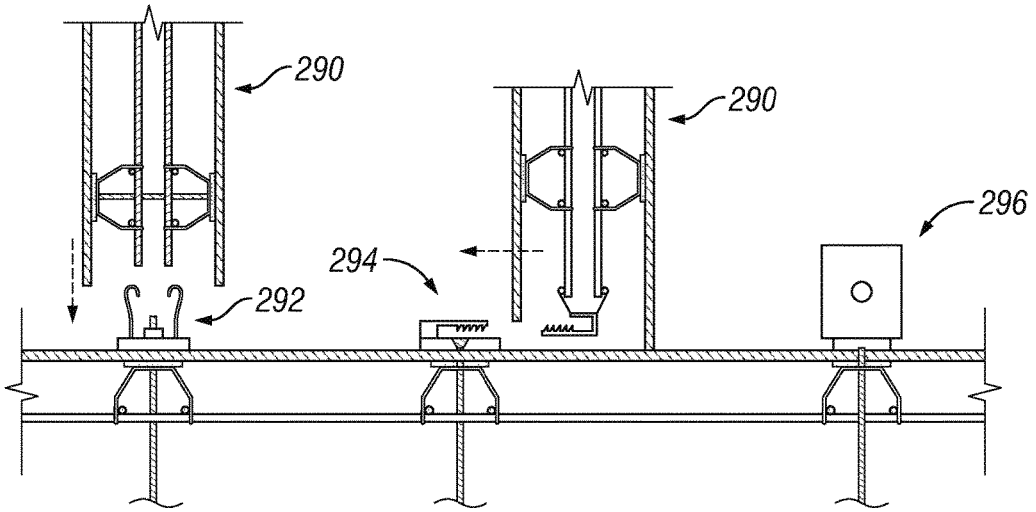
FIG. 17 shows various connection mounts for connection of wall assemblies to floor form assemblies or deck assemblies.

The versatility of the method and system as disclosed herein provides additional capability for interior walls. For example, buildings can be formed with concrete interior walls for sound proofing and thermal control. In the alternative, non-load bearing interior wall assemblies 290 can be filled with foam rather than concrete. In this embodiment, foam can be added either at the manufacturing facility or onsite. According to one embodiment, wall assemblies presented for interior use can be reduced in structure. For example, structural columns 114 can be substituted with wood or plastic. In the alternative, low gauge conduit can be used in place of structural columns 114. For interior wall assemblies 290 that need not bear the load of liquid concrete, structural columns 114 can be removed altogether, as seen in FIG. 17. In addition, rebar mats 112 and 116 can be significantly lower gauge. Furthermore, spacer bolts 142 need not be placed as frequently.

In one embodiment, interior wall assemblies 290 can be attached to floor forms assembly 260 through stabbing floor mounts 296 that stab into structural columns 114 or the substitute for the columns. In one embodiment, upper clip floor mounts 292, bolted to the floor form assembly, have upper clips that clip automatically into the lower portion of rebar mats 112 and 116 of interior wall assembly 100 when the wall assemblies are put in place. See FIG. 17.

In one embodiment, interior wall assemblies 290 are mounted by sliding the assembly 100 over slide clips that are premounted to floor form assembly 260. In this embodiment, interior wall assemblies 290 can be bolted to the non-load bearing wall or partially filled with concrete to reinforce the connection between interior wall assembly 290 and sliding clip floor mount 294. In the alternative, self-tapping screws can be drilled between straps 140 of interior wall assemblies 290 and straps 140 of floor form assemblies 260 or deck assemblies 280 according to conventional building methods known in the art.

In conventional residential construction, the roof support is usually formed by wood roof trusses that provide strong support in a basic triangle shape. The trusses are then decked with plywood or wood planks, and then covered with an architectural roof covering to shed water and moisture. This requires framing contractors to complete the truss construction and installation. Roofing contractors come behind to install the roofing material. According to the present disclosure, prefabricated roof assemblies are shipped to the jobsite already configured for installation, with architectural roof coverings already in place. Moreover, these roof assemblies can be manufactured according to the same or similar design as the other assemblies disclosed herein.

Figure 18:
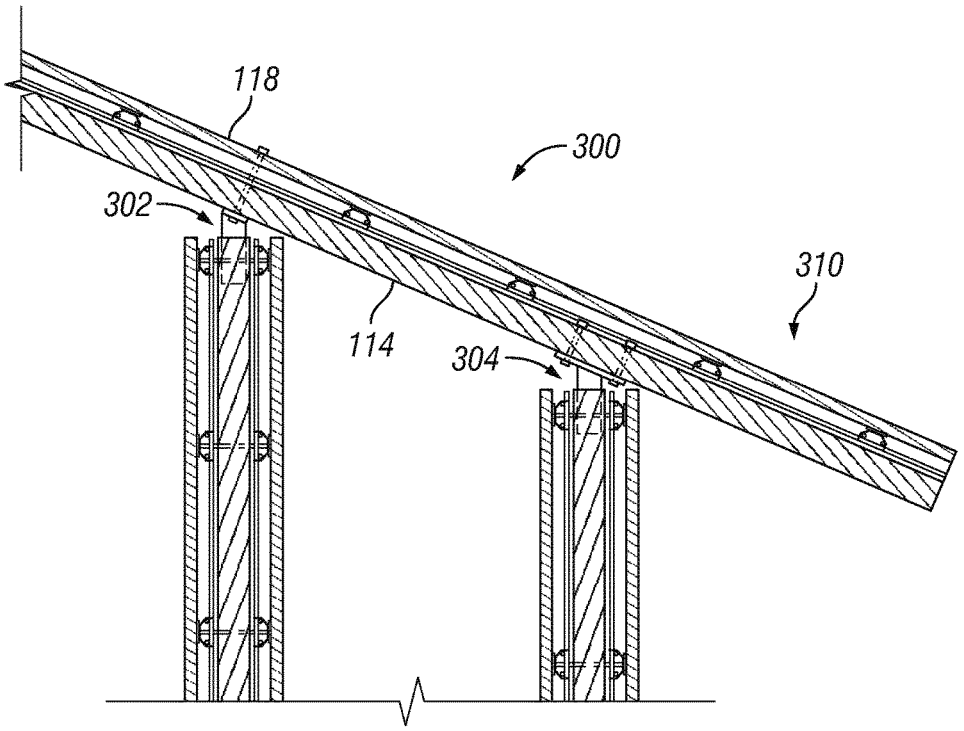
FIG. 18 shows connection mounts for connection of roof assemblies to wall assemblies.
Figure 19:
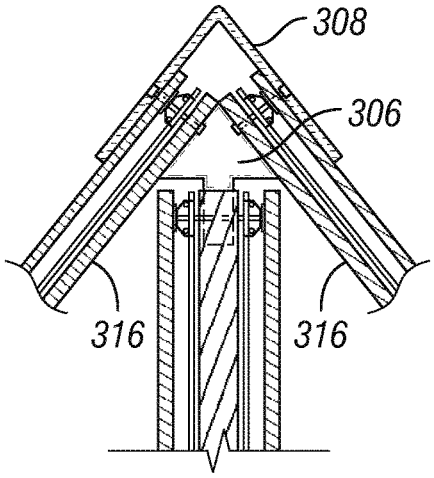
FIG. 19 shows an apex roof mount for connection of roof assemblies to wall assemblies.

FIGS. 18 and 19 show one embodiment of the roof section, according to the present disclosure. Roof segments can be fashioned from the same system and method as wall assembly 100. In one embodiment, roof assembly 300 comprises the components of wall assembly 100 except for interior space frame 124 and interior skin panel 110. Roof assembly 300, in this embodiment, is not operable for concrete to be poured within the panels, so the additional interior rebar mat 112 is not required. Roof assembly 300 maintains structural strength, however, from the half space frame truss created by structural column 114 exterior rebar mat 116, spacers 120, and straps 140.

Structural columns 114 of roof assemblies 300 are connected to structural columns of wall assemblies 100 through roof mounts 302, 304, and/or 306. The lower portion of these roof mounts are stabbing splices, such as stabbing splice 144 described above. Mid-roof aligned roof mount 302 is used where the bolt holes of structural columns 114 of roof assembly 300 line up with structural column 114 of wall assembly 100, such as for certain pitched roofs. Mid-roof aligned roof mount 302 comprises a stabbing splice at the lower portion, an angled upper portion according to the preferred pitch of the roof, and a threaded bolt hole for receipt of a bolt from the exterior of the roof. In one embodiment, the bolt connecting mid-roof aligned roof mount 302 to roof assembly 300 does not pierce roof assembly 300. Instead, the bolt is threaded and torqued down from the underside of mount 302. In one embodiment, the bolt only threads to structural column 114 of roof assembly 300. In another embodiment, the bolt traverses roof assembly 300 all the way to exterior skin panel 118, as shown in FIG. 18.

In some situations, wall assembly 100 will not line up with the bolt holes of structural column 114 of roof assembly 300. For these situations, mid-roof misaligned roof mount 304 can be used. Mount 304 shifts the bolt pattern to align with the bolt holes on structural columns 114. This can be predetermined, or the bolt plate of mount 304 can slide into place and be torqued down. In another embodiment (not shown), mid-roof misaligned roof mount simply attaches to rebar mat 116 by way of cinch down clips known in the industry.

Figure 20A:
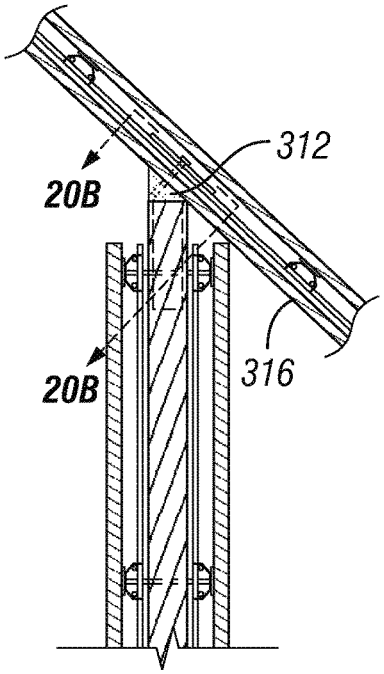
FIGS. 20A-C show alternative connection mounts for connection of roof assemblies to wall assemblies.
Figure 20B:
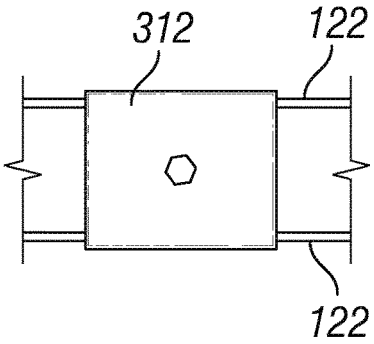
Figure 20C:
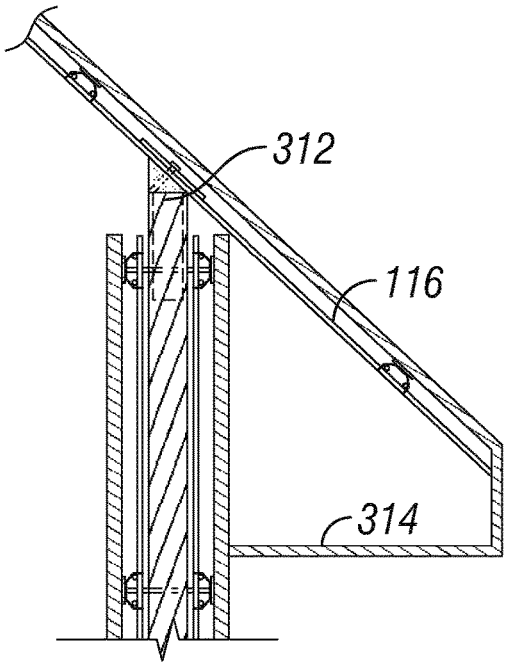

In some embodiments, it is desired to connect wall assembly 100 to a portion of roof assembly 300 in between structural column 114 of roof assembly 300. Where this occurs, it is possible to connect wall assembly 100 to rebar mat 116 of roof assembly 300 using a mid-roof misaligned rebar roof mount 312 as seen in FIGS. 20A-C. Mid-roof misaligned rebar roof mount 312 is a metal plate, for example having the dimensions ⅛"×4"×6", that fits over two rebar strings 122 of roof assembly 300 rebar mat 116. Metal plate 312 may be curved at its edges to present a groove for rebar strings 122 to fit. Metal plate 312 contains at least one threaded hole therein for bolting to wall assembly 100. Metal plate 312 slides along two rebar strings 122 of roof assembly 300 until it lines up with the bolt of mid-roof aligned roof mount 302 or mid-roof misaligned roof mount 304. As metal plate 312 is torqued down, it locks into place along rebar mat 116, thereby creating a structurally solid connection.

Where two roof assemblies 300 meet at the apex of a roofline, apex roof mount 306 is used. See FIG. 19. This triangular mount stabs into structural column 114 of wall assembly 100 and provides two receptacles for bolts, one from each roof assembly 300. In the embodiment shown in FIG. 19, bolts first run through apex roof cover 308 before traversing roof assembly 300 and into apex roof mount 306. Roof assembly 300 can include its own structural column 114 as shown in FIG. 18. This provides additional rigidity and strength where needed, such as in hurricane prone areas. In the alternative, roof assembly 300 contains no structural column as seen in FIG. 20C. In yet another embodiment, an alternative reinforcement plate 316 can be used in place of structural column 114, as seen in FIGS. 19 and 20A. Reinforcement plate 316 can take the form of c-channel or z-channel known in the art, which provides additional rigidity without the weight and cost of a full structural column 114. In another embodiment, larger rebar 122 is used and/or a deeper spacer 120 in order to increase the structural rigidity of roof assembly 300.

With the design herein, roofs can be placed, bolted, and finished in a matter of hours. The panels are installed in complete lengths that span from the roof apex or roof peak to the exterior walls plus overhang 310, as shown in FIG. 18. In one embodiment, overhang support 314 is bolted to structural column 114 of wall assembly 100 and attached to the edge of roof assembly 300, as seen in FIG. 20C. Roof assembly 300 can include architectural roof finishes common to the housing industry. For example, exterior skin panels can comprise rubber finishes such as Thermoplastic Polyolefin (TPO), Ethylene Propylene Diene Monomer (EPDM) or Polyvinyl Chloride (PVC) membranes. Or the skin panels can be fashioned with other components known in the industry such as shingles, tiles, slate, metal, fiber cement, siding, or asphalt. After roof assembly panels 300 are placed and bolted, a small crew need only patch the bolt holes, seal apex roof cover 308 (if used), and seal the panels to each other.

Roof assembly panels 300 can be fabricated in the widest panel sizes consistent with shipping restraints. Roof panels are designed to be installed with several slopes, such as 12/12, 9/12, 6/12, 3/12, 2/12, or other slopes. In severe weather areas such as those with heavy snow seasons, roof assembly 300 can be fashioned with heavier gauge components such as heavier rebar strings 122, exterior skin panels 118, and/or straps 140. In addition, knee braces known in the industry can be installed that extend from the center bearing walls to intermediate support. In situations where a cathedral ceiling is desired, roof assembly 300 can contain an interior skin panel 110, as described above. Roof assemblies 300 can be filled with expandable foam for additional insulation in cathedral ceiling situations. Where applications call for increased structural integrity, such as in areas prone to hurricanes or tornados, concrete can be used within roof assembly panels 300 as an inclined beam.

Roof assembly panels 300 can accommodate several structural and architectural features, such as dormers, chimneys, exhaust vents, ridge vents, and gutters. Where exterior skin panel 118 cannot structurally bear the load of the architectural feature, it can be affixed to any component of space frame 124—such as structural column 114, exterior rebar mat 116, spacers 120, or straps 140—using clips or bolts.

According to the present disclosure, predesigned utility distribution systems can be prebuilt into the wall, deck, and roof assemblies in order to minimize onsite installation times and cost. The utility distribution systems available include electrical distribution, water distribution, sewage collection systems, low-voltage wiring distribution, and HVAC (Heating, Ventilation, and Air Conditioning) distribution.

In conventional residential construction, the utilities are completed by licensed subcontractors according to acceptable building codes and construction timelines. These are subject to inspection at certain hold points, which add delays and cost to a building's construction. The licensed subcontractors traditionally install the distribution utilities at three different time frames in the building cycle. After clearing of the building site but prior to placement of the foundation, contractors install sewer outlets, water inlets, and underground electrical conduits. Next, after completion of the wood framing and the outside sheathing, contractors run electrical wiring, low voltage wiring, internal plumbing, and HVAC lines. To do this, contractors must drill or cut holes through the existing framing and plant cut protectors on the punch through studs, making it a time consuming and expensive process. Work must be halted at each stage for local inspections to occur. Finally, after closure of outside siding and inside sheetrock, installation of exterior fixtures and outlet covers occurs.

The system and method disclosed herein reduces both the time and cost of utility installation because the majority of the process can occur in the controlled environment of the manufacturing facility. In addition, much can be completed by robotic assistance. This means that distribution utilities are completed onsite in less time by less expensive semi-skilled labor. It also eliminates subcontractor interfaces that can dramatically lengthen or disrupt the construction schedule because each phase of building need not be delayed due to individual subcontractors. Furthermore, many hold points can be eliminated because the inspections can be verified at the manufacturing facility en masse.

According to one embodiment, utility distribution conduits are preinstalled in wall assemblies 100, floor form assemblies 260, deck assemblies 280, interior wall assemblies 290, and roof assemblies 300. Certain conduits can also be run in wall foundation assemblies 200 and spread footer wall foundation assemblies 220. Conduits are mounted to the space frame 124 using clips, mounts, straps, or bolts. Where two panel assemblies are connected, conduits are provided with couplers either preinstalled, or the conduits are coupler ready. Because concrete is to be poured into most panel assemblies, connections are usually made prior to pouring. However, for time savings, because concrete pouring can be done in stages, conduit connections can be made at various levels as the concrete is soft setting.

According to one embodiment, conduits are run at various levels within the panel assemblies, and at various depths. For example, electrical conduit may be run closer towards the interior skin panel 110, while the water conduit can be run behind, closer to the plane of structural column 114. In one embodiment, utility conduits are run in the space between the plane of structural column 114 and exterior skin panel 118. For ease of connections, utility conduits can be run at the top and bottom sections of wall assemblies 100, or the comparable side sections of other panel assemblies. For bottom-run utility conduits, the conduits are connected while the wall assembly sections are suspended in place by a light-duty crane. Top-run connections do not require suspension. It is contemplated that some utilities will have secondary conduits for backup purposes.

In one embodiment, skin panel punch out plates are contemplated, where conduit connections can be made through the skin section of a panel assembly after the assemblies have been placed and connected. The punch out section is then patched accordingly after the conduit is connected. In one story buildings, top-run conduits are left exposed above the concrete line. This provides easy access to the conduit lines for maintenance purposes. For conduits submerged in concrete, junction box access panels may be used. This allows for wiring repair and updates, or water line/sewer clean out as necessary.

The designs disclosed herein can be used to fashion entire structures on-site in a fraction of the time of conventional builds and with lower installed costs. In addition, wall assemblies 100 can also be used as curtain walls for larger structures like large office buildings and skyscrapers. In one embodiment, wall assembly 100 is used as a load bearing, or non-load bearing outer cover of a building. The lightweight preassembled wall is lifted into place and tied to the supporting columns and then concrete poured to complete the skirt wall. The reinforced concrete design disclosed herein provides exceptional resistance to horizontal wind loads, while the air-tight nature of the present disclosure resists air and water infiltration. In one embodiment, reinforced concrete in wall assembly 100 provides some structural capability. Interior wall assemblies 290 can also be used in larger structures, via at least the methods described above.

As mentioned, the offsite prefabrication of the panel assemblies saves both time and construction costs. The panel assemblies are constructed at a manufacturing facility under robotic control. According to one embodiment, rebar strings 122 are laid in place horizontally. Robotic arms weld spacers 120 to rebar string 122 cross points to create a rebar mat. The rebar mat is then placed retracted 90 degrees into a vertical position where it is slid into place around spaced apart structural columns 114. Skin panels 110 and 118 having thermal insulation panels 270 and straps 140 already attached are slid into place on either side of the rebar mats 112 and 116. Robotic drills then pierce the panel assembly and insert spacer bolts 142 to complete the framing. In one embodiment, robotic cutters then remove sections of the panel assembly for insertion of window frames and door frames. In an alternate embodiment, the exterior fiber cement form is attached to the steel mat to form a complete panel, and then added to vertical columns.

As disclosed herein, preassembled panel assemblies are transported on truck, train, or barge to the jobsite, where they are lifted into place by light duty crane. Several panel assemblies can be transported on one truck, the dimensions of the panel assembly restricted only by the dimensions of the truck and local transport regulations. One truck, for example, can bring to a jobsite enough panel assemblies to build a small structure, such as a one-story home. A larger home may require only two or three trucks. In one embodiment, transportation dimensions of the apparatus of the present disclosure can be reduced still further. For example, it is contemplated that components of panel assemblies 100 can be stacked within shipping containers. In this design, preassembled rebar mats 112 are combined with spacers 120 to form a space frame segment. Because the spacers are angled in a somewhat triangular shape in one embodiment, as seen in FIGS. 4B-C, one space frame segment stacks over another. According to this embodiment, structural columns 114, space frame segments, straps 140, and skin panels 110, 118 are all shipped separately packed in containers. Space frames 124 and subsequent panel assemblies 100 are then assembled onsite. This compact transportation solution is well suited for large military installations, for example, where structural materials for an entire complex can fit in just a few shipping containers. Even though additional onsite assembly is required, the components as shipped are essentially bolted together. No welding is required, according to one embodiment.

Although the present disclosure and its advantages have been described in detail, it should be understood that various changes, substitutions and alterations can be made herein without departing from the spirit and scope of the design as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the present disclosure, processes, machines, manufacture, compositions of matter, means, methods, or steps, presently existing or later to be developed that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

What is claimed is:

1. A modular panel assembly comprising:

one or more structural columns, each structural column having a first side and second side different from the first side, wherein the one or more structural columns primarily comprise metal;

a first rebar mat having a first side and a second side different from the first side, the first side of the rebar mat connected to the first side of the one or more structural columns;

a second rebar mat having a first side and a second side different from the first side, the first side of the second rebar mat connected to the second side of the one or more structural columns;

a first skin panel connected to the second side of the first rebar mat;

a second skin panel connected to the second side of the second rebar mat; and a plurality of spacers connected to each of the first and second rebar mats, the plurality of spacers configured to prevent direct contact between the first rebar mat and first skin panel and between the second rebar mat and the second skin panel, wherein the first skin panel connected to the first rebar mat and the second skin panel connected to the second rebar mat are configured to define a center region for accepting foam or concrete.

2. The panel assembly of claim 1, further comprising straps positioned between the spacers and the skin panels.

3. The panel assembly of claim 1, further comprising a plurality of spacer bolts attached to the spacers and configured to provide resistance against skin panel deformation.

4. The panel assembly of claim 1, wherein the first and second skin panels comprise cement fiber board.

5. The panel assembly of claim 1, wherein the structural columns are load bearing.

6. The panel assembly of claim 1, further comprising a foldout rebar frame.

7. The panel assembly of claim 5, further comprising a hinge connected to at least one skin panel, wherein a portion of the at least one skin panel protracts to form a shell of a spread footer foundation.

8. The panel assembly of claim 1, further comprising a mount for moving the panel assembly by crane.

9. The panel assembly of claim 1, further comprising conduit for utilities.

10. The panel assembly of claim 1, further comprising a stabbing splice for connecting two panel assemblies together.

11. The panel assembly of claim 1, further comprising a window or door frame.

12. A method of preparing a panel assembly comprising:

connecting a first skin panel to a first side of a first rebar mat;

connecting a second side of the first rebar mat different from the first side of the rebar mat to a first side of one or more structural columns, wherein the one or more structural columns primarily comprise metal;

connecting a second side of the one or more structural columns different from the first side of the one or more structural columns to a first side of a second rebar mat;

connecting a second side of the second rebar mat different from the first side of the second rebar mat to a second skin panel; and connecting a plurality of spacers to each of the first and second rebar mats, such that the plurality of spacers prevent direct contact between the first rebar mat and first skin panel and between the second rebar mat and the second skin panel, wherein the first skin panel is connected to the first rebar mat and the second skin panel is connected to the second rebar mat to create a space between the first and second skin panels for accepting foam or concrete.

13. The method of claim 12, further comprising receiving foam or concrete in at least a portion of the space.

14. The method of claim 12, further comprising attaching a plurality of straps to the first and second skin panels between the first and second skin panels and the plurality of spacers.

15. The method of claim 12, further comprising:

transporting the panel assembly to a jobsite; and connecting the panel assembly to another panel assembly to form a structure.

16. The method of claim 15, further comprising:

attaching a leveling apparatus to the panel assembly; and leveling the panel assembly.

17. The panel assembly of claim 8, where the mount is configured to be coupled to at least one of the one or more structural columns.

18. The panel assembly of claim 1, further comprising thermal insulation positioned between the first and second skin panels.

19. The panel assembly of claim 1, wherein the plurality of spacers provide structural strength to the panel assembly while the panel assembly is transported to the jobsite.

20. The method of claim 15, further comprising connecting the panel assembly to another panel assembly to form an interior wall of a building.

* * * * *